US008920012B2

(12) United States Patent
Yagi

(10) Patent No.: US 8,920,012 B2
(45) Date of Patent: Dec. 30, 2014

(54) LAMP UNIT

(71) Applicant: Takayuki Yagi, Shizuoka (JP)

(72) Inventor: Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 88 days.

(21) Appl. No.: 13/871,574

(22) Filed: Apr. 26, 2013

(65) Prior Publication Data

US 2013/0308330 A1 Nov. 21, 2013

(30) Foreign Application Priority Data

Apr. 27, 2012 (JP) ..... 2012-102974

(51) Int. Cl.
*F21V 5/04* (2006.01)
*F21S 8/10* (2006.01)

(52) U.S. Cl.
CPC ..... *F21V 5/04* (2013.01); *F21S 48/1258* (2013.01); *F21S 48/1159* (2013.01); *F21S 48/1154* (2013.01)
USPC ..... 362/522; 362/538

(58) Field of Classification Search
USPC ..... 362/522, 538
See application file for complete search history.

(56) References Cited

U.S. PATENT DOCUMENTS 7,168,832 B2 * 1/2007 Komatsu et al. ..... 362/507
7,976,203 B2 * 7/2011 Okada ..... 362/509
2013/0272011 A1 * 10/2013 Fedosik et al. ..... 362/522

FOREIGN PATENT DOCUMENTS

JP 2009-043543 A 2/2009

OTHER PUBLICATIONS

Patent Abstracts of Japan, Publication No. 2009-043543; Publication Date: Feb. 26, 2009 (1 Page).

* cited by examiner

*Primary Examiner* — David V Bruce
(74) *Attorney, Agent, or Firm* — Osha Liang LLP

(57) ABSTRACT

A lamp unit mounted in a vehicle includes a light source, a light source mounting portion on which the light source is mounted, and a projection lens having a front surface with a convex shape and configured to project light from the light source to the front of the lamp unit. When looking at the lamp unit from the front, the front surface of the projection lens takes a substantially round shape which is centered at an optical axis of the lamp unit in a position which lies closer to a front end portion and a substantially non-round shape at a rear end portion. The front surface changing gradually its shape from the substantially round shape to the substantially non-round shape in a region between the position and the rear end portion as it extends from the position towards the rear end portion.

6 Claims, 20 Drawing Sheets

LAMP UNIT

CROSS-REFERENCE TO RELATED APPLICATION(S)

The present application claims the benefit of priority of Japanese Patent Application No. 2012-102974 filed on Apr. 27, 2012. The disclosures of the application are incorporated herein by reference.

BACKGROUND

1. Technical Field

The present disclosure relates to a lamp unit and more particularly to a lamp unit adapted to be mounted on a vehicle.

2. Related Art

A lamp unit including a projection lens is known as a lamp unit configured to be mounted on a vehicle. In this lamp unit, a projection lens is disposed on a front side of a light source, and light emitted from the light source is irradiated to the front of the lamp unit through the projection lens. A planoconvex or biconvex lens having a circular shape as seen from the front thereof is used as the projection lens. On the other hand, for example, Patent Literature 1 discloses an anomalous projection lens for a vehicle lamp, and this projection lens has a polygonal shape as seen from the top thereof and has an edge (ridge) on a surface thereof.

RELATED ART LITERATURE

Patent Literature

[Patent Literature 1] JP-A-2009-43543

In these situations, the inventor has come to recognize the following problem. Namely, the aforesaid anomalous projection lens has the edge (ridge) which extends on a front surface thereof, and therefore, with this projection lens, compared with a similar projection lens having no such ridge, it becomes difficult to direct light that exits from the projection lens in a desired direction. Consequently, with a lamp unit including such a projection lens, compared with a lamp unit including a projection lens which has no such ridge on a front surface thereof, it becomes difficult to control the light distribution thereof. In particular, in a projection lens, much of the light from a light source generally passes through a central area of the lens. Because of this, in order to control the light distribution of a lamp unit with high accuracy, it is required to control the direction of light that exits from a central area of a projection lens in the lamp unit with high accuracy.

SUMMARY

Exemplary embodiments of the invention provide a lamp unit including an anomalous projection lens which can suppress the reduction in accuracy with which the light distribution of is controlled.

A lamp unit configured to be mounted in a vehicle, according to an exemplary embodiment, comprises:

a light source;

a light source mounting portion on which the light source is mounted; and a projection lens having a front surface with a convex shape and configured to project light from the light source to the front of the lamp unit, wherein when looking at the lamp unit from the front, the front surface of the projection lens takes a substantially round shape which is centered at an optical axis of the lamp unit in a position which lies closer to a front end portion and a substantially non-round shape at a rear end portion, the front surface changing gradually its shape from the substantially round shape to the substantially non-round shape in a region between the position and the rear end portion as it extends from the position towards the rear end portion.

According to the exemplary embodiment, it is possible to provide a lamp unit including an anomalous projection lens which can suppress the reduction in accuracy with which the light distribution of is controlled.

A lamp unit configured to be mounted in a vehicle, according to an exemplary embodiment, comprises:

a light source;

a light source mounting portion on which the light source is mounted; and a projection lens having a front surface with a convex shape and configured to project light from the light source to the front of the lamp unit, wherein an outline of the front surface of the projection lens which bounds a cross section which is parallel to a plane which contains a full circumference of a rear end portion takes a substantially round shape in a position which lies close to a front end portion and a substantially non-round shape at the rear end portion, the outline changing gradually its shape from the substantially round shape to the substantially non-round shape as it changes its position from the position towards the rear end portion.

According to the exemplary embodiment, it is possible to provide a lamp unit including an anomalous projection lens which can suppress the reduction in accuracy with which the light distribution of is controlled.

In the lamp unit, in a rear surface of the projection lens, a first region which contains a point of intersection which intersects an optical axis of the lamp unit may take a substantially rotationally symmetric shape which is centered at the point of intersection, and a second region outside of the first region takes a shape defined by a free curved surface, light that passes through a rear focal point of the projection lens to enter the first region of the rear surface may exit from a region defined from the front end portion to the position of the front surface, and light that passes through the rear focal point of the projection lens to enter the second region may exit from a region defined between the position to the rear end portion of the front surface.

By adopting this configuration, the area from the position which lies close to the front end portion on the front surface to the rear end portion can also be used to form the light distribution pattern.

In the lamp unit, the substantially non-round shape may be a polygonal shape, and the front surface of the projection lens may have ridges in the region defined from the rear end portion to the position and have no ridge in the region defined from the position to the front end portion.

By adopting this configuration, the exit direction of the light that exits from the central area of the projection lens can be controlled with high accuracy, and therefore, the accuracy with which the light distribution of the lamp unit is controlled can be increased.

According to the exemplary embodiment of the invention, it is possible to provide e a lamp unit including an anomalous projection lens which can suppress the reduction in accuracy with which the light distribution of is controlled.

DETAILED DESCRIPTION

Figure 1:
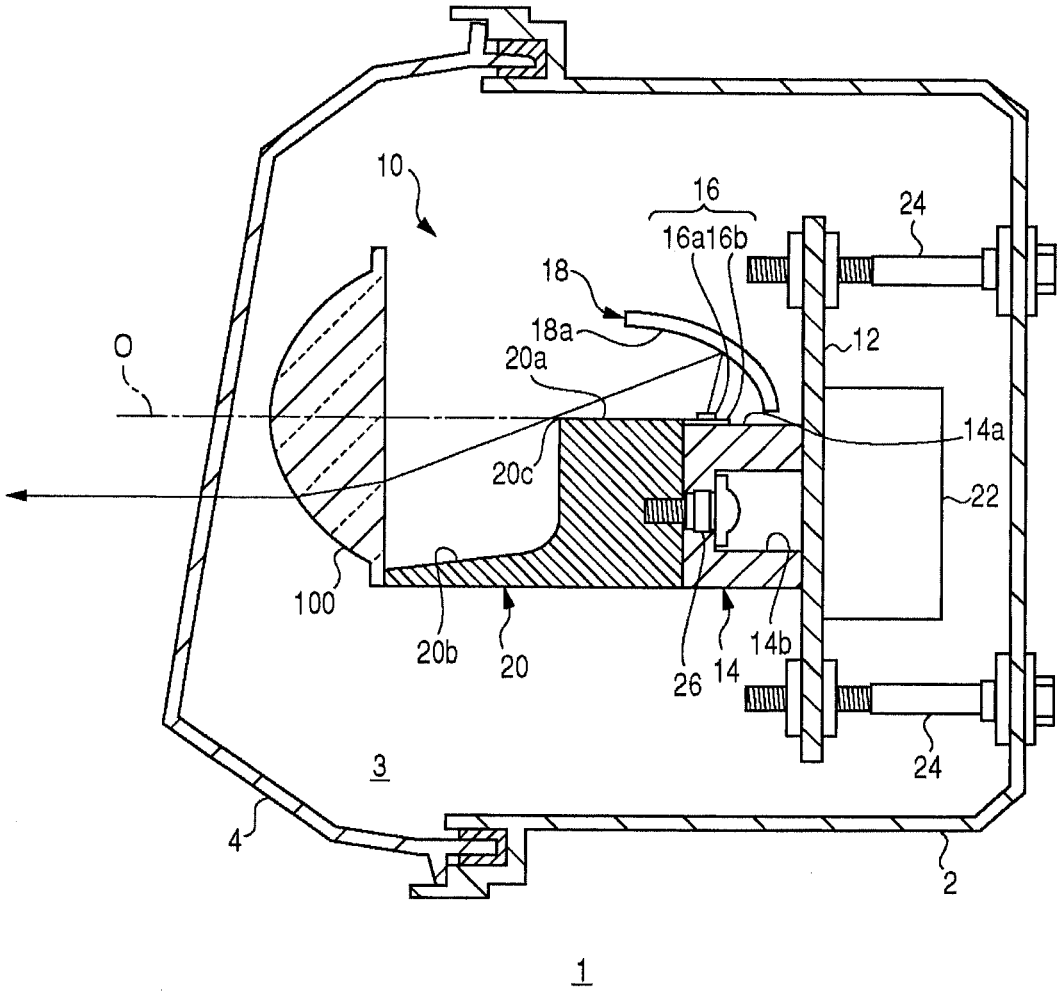
FIG. 1 is a vertical sectional view showing exemplarily a schematic construction of a vehicle lamp in which a lamp unit according to a first embodiment is mounted.

Hereinafter, the invention will be described based on preferred embodiments by reference to the drawings. Like reference numerals will be given to like or similar constituent elements, members and processes shown in the drawings, and the repetition of similar descriptions will be omitted as required. In addition, the embodiments to be described are not intended to limit the invention but are intended to illustrate the same. All the features that are described in the embodiments and combinations thereof are not necessarily the essence of the invention.

First Embodiment

FIG. 1 is a vertical sectional view showing exemplarily a schematic construction of a vehicle lamp in which a lamp unit according to the first embodiment is mounted. A vehicle lamp 1 described in this embodiment is a vehicle headlamp apparatus having a pair of headlamp units which are disposed at left front and right front portions of a vehicle. Since the pair of headlamp units is substantially identical in configuration, FIG. 1 shows as the vehicle lamp 1 the construction of a headlamp unit which is disposed at either of the left front and right front portions of the vehicle.

As shown in FIG. 1, the vehicle lamp 1 includes a lamp body 2 having an opening portion in a front side of a vehicle and a transparent cover 4 mounted so as to cover the opening portion of the lamp body 2. The transparent cover 4 is formed of a resin having a light transmissivity. A lamp unit 10 is accommodated within a lamp chamber 3 which is defined by the lamp body 2 and the transparent cover 4.

The lamp unit 10 is a so-called reflector-type lamp unit and includes a bracket portion 12, a light source mounting portion 14, a light source module 16 (a light source), a reflector 18, a shade portion 20 and a projection lens 100.

The bracket portion 12 is a substantially plate-shaped member which is made of a metallic material such as aluminum, for example and is disposed so that main surfaces are directed in a front-to-rear direction of the vehicle lamp 1. The light source mounting portion 14 is fixed to a front main surface of the bracket portion 12 which lies at a front side of the vehicle lamp 1. A head dissipating fin 22 is fixed to a rear main surface of the bracket portion 12 which lies at a rear side of the vehicle lamp 1. The bracket portion 12 has screw holes in predetermined positions on a peripheral portion thereof, so that aiming screws 24, which penetrate the lamp body 2 to project to the front, are screwed in the screw holes. By doing so, the bracket portion 12 is mounted on the lamp body 2. In the vehicle lamp 1, an optical axis O of the lamp unit 10 can be adjusted horizontally or vertically by the aiming screws 24. It should be noted that the shape of the bracket portion 12 is not limited to the shape described above.

The light source mounting portion 14 is formed of a metallic material such as aluminum, for example and projects to the front side of the vehicle lamp 1 from the front main surface of the bracket portion 12. The light source mounting portion 14 has a light source module mounting surface 14*a* which is oriented vertically upwards relative to the optical axis O of the lamp unit 10. The light source module 16 is mounted on the light source module mounting surface 14*a*. Additionally, an insertion hole 14*b* is provided in a predetermined position on the light source mounting portion 14, so that a fastening member 26, which will be described later, is inserted therethrough.

The light source module 16 is disposed so that a light exit surface thereof is oriented substantially vertically upwards relative to the optical axis O. The light source module 16 is, for example, a light emitting diode (LED) and has a light emitting element 16*a* and a substrate 16*b* which supports the light emitting element 16*a* thereon. A wiring is provided in the substrate 16*b* so as to supply electric power to the light emitting element 16*a* mounted thereon. It should be noted that an incandescence lamp, a halogen lamp or a discharge lamp may be used as a light source used in the lamp unit 10. Heat generated from the light source module 16 is transmitted to the heat dissipating fin 22 by way of the light source mounting portion 14 and the bracket portion 12.

The reflector 18 has a substantially dome-like shape and is fixed to the light source mounting portion 14 while being disposed above the light source module 16. The reflector 18 has a reflection surface 18*a* which is made up of part of an ellipsoid of revolution on an inner side thereof. This reflection surface 18*a* has a first focal point and a second focal point which is positioned further forwards towards the front side of the vehicle lamp 1 than the first focal point. A positional relationship of the reflector 18 with the light source module 16 is determined so that a light emitting portion of the light source module 16 substantially coincides with the first focal point of the reflection surface 18*a*.

The shape portion 20 is provided on a front side of the light source mounting portion 14 which lies at the front side of the vehicle lamp 1. The shade portion 20 is fixed to the light source mounting portion 14 by the fastening member 26, which is, for example, a screw which projects towards the front side of the vehicle lamp 1 from the insertion hole 14*b* in the light source mounting portion 14. The shade portion 20 has a flat portion 20*a* which is disposed substantially horizontally and a curved portion 20*b* that is disposed further forwards towards the front side of the vehicle lamp 1 and which is curved downwards so as not to interrupt the entrance of light from the light source to the projection lens 100. A positional relationship of the reflector 18 with the shade portion 20 is determined so that a ridge 20*c* which is formed by the flat portion 20*a* and the curved portion 20*b* of the shade portion 20 is positioned near the second focal point of the reflection surface 18*a*.

The shade portion 20 also functions as a lens holder, and the projection lens 100 is fixed to a distal end of the curved portion 20*b*. The projection lens 100 is a light transmissive member whose front surface is a convex surface and which projects light from the light source module 16 that is mounted on the light source mounting portion 14 to the front of the vehicle lamp 1. The projection lens 100 projects a light source image which is formed on a rear focal plane which includes a rear focal point thereof onto an imaginary vertical screen ahead of the vehicle lamp 1 as a reverted image. The projection lens 100 is disposed on the optical axis O of the lamp unit 10 in such a position that the rear focal point substantially coincides with the second focal point of the reflection surface 18*a* of the reflector 18. The shape of the projection lens 100 will be described in detail later.

Light emitted from the light emitting element 16*a* of the light source module 16 is reflected on the reflection surface 18*a* of the reflector 18, passes near the second focal point of the reflection surface 18*a* or the ridge 20*c* and enters the projection lens 100. The light that has entered the projection lens 100 is irradiated from the projection lens to the front of the vehicle lamp 1 as substantially parallel light. Additionally, part of the light from the light source is reflected on the flat portion 20*a* of the shape portion 20, whereby the light from the light source is cut selectively from the ridge 20*c* as a boundary. By doing so, a light distribution pattern having a cutoff line which corresponds to the shape of the ridge 20*c* is projected to the front of the vehicle.

Figure 2A:
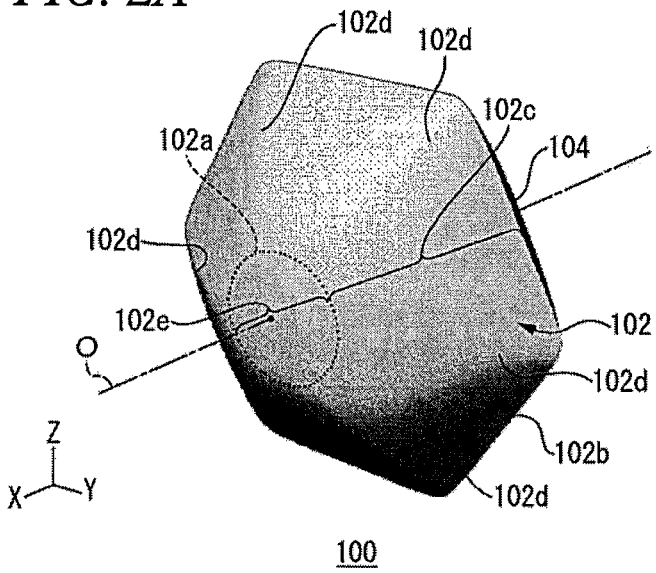
FIG. 2A is a perspective view of projection lens provided in the lamp unit according to the first embodiment as seen from the front of the vehicle lamp.
Figure 2B:
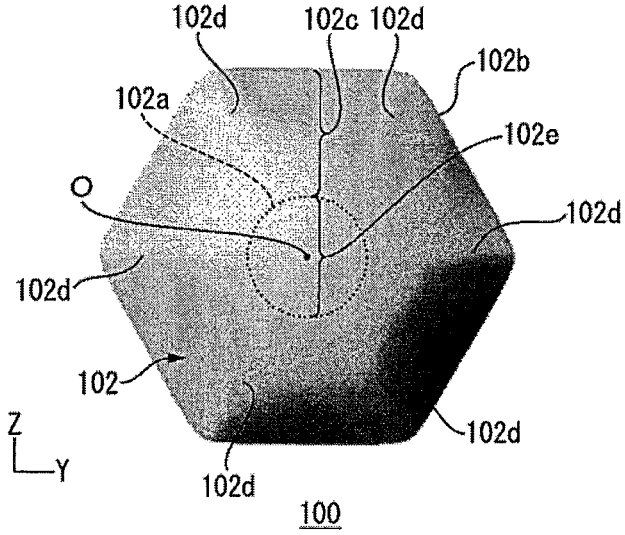
FIG. 2B is a front view of the projection lens.
Figure 3A:
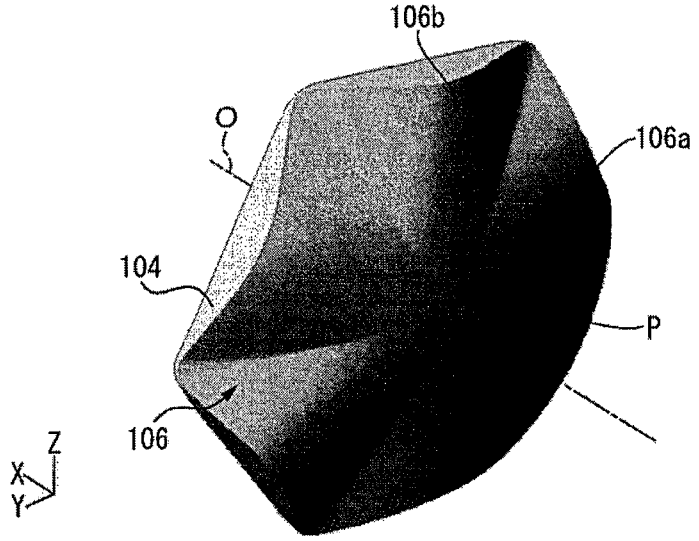
FIG. 3A is a perspective view of the projection lens from the rear of the vehicle lamp.
Figure 3B:
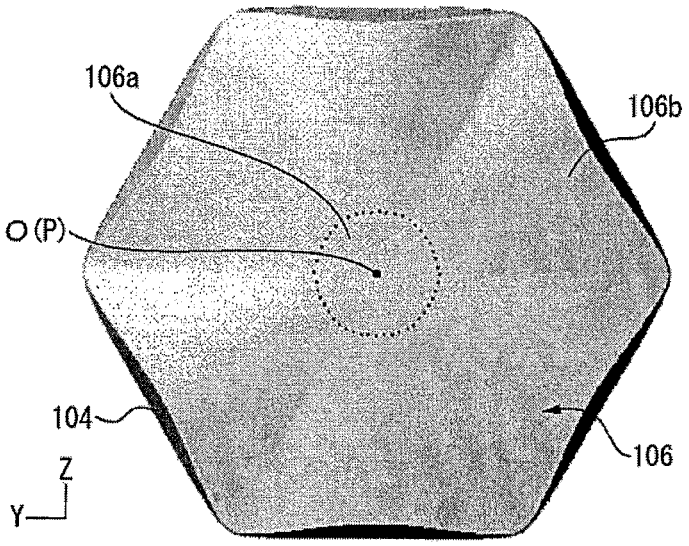
FIG. 3B is a rear view of the projection lens.
Figure 4A:
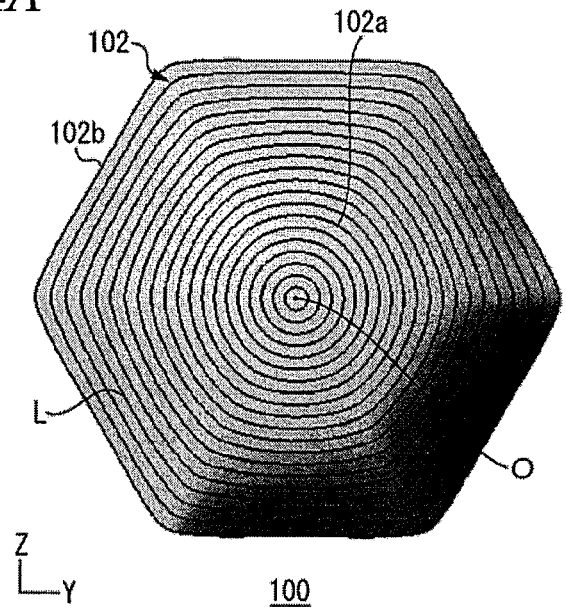
FIG. 4A is a front view of the projection lens which describes the shape of the front surface of the projection lens.
Figure 4B:
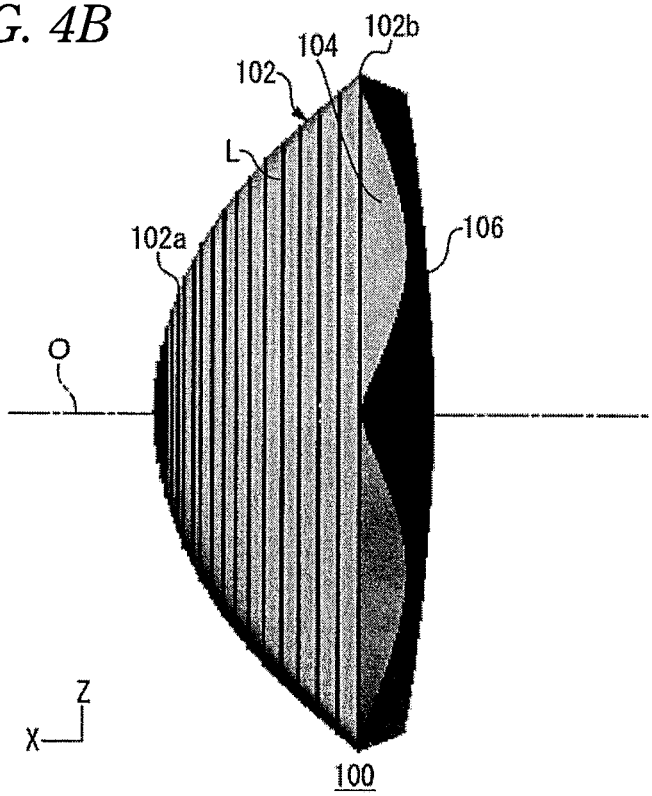
FIG. 4B is a side view of the projection lens which describes the shape of the front surface of the projection lens.
Figure 5:
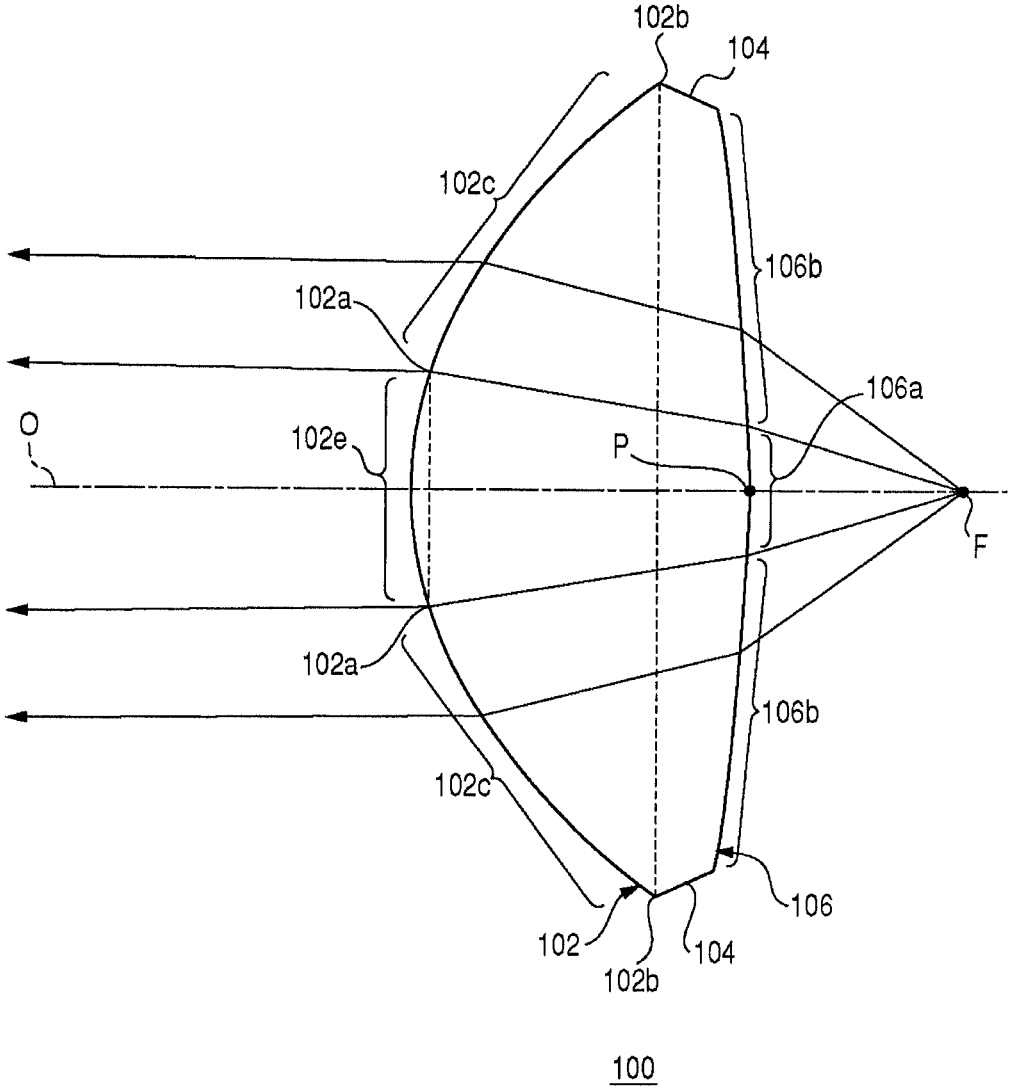
FIG. 5 is a vertical sectional view of the projection lens.

Next, the shape of the projection lens 100 will be described in detail. FIG. 2A is a perspective view of the projection lens provided in the lamp unit according to the first embodiment as seen from the front of the vehicle lamp 1. FIG. 2B is a front view of the projection lens. FIG. 3A is a perspective view of the projection lens from the rear of the vehicle lamp 1. FIG. 3B is a rear view of the projection lens. FIG. 4A is a front view of the projection lens which describes the shape of the front surface of the projection lens. FIG. 4B is a side view of the projection lens which describes the shape of the front surface of the projection lens. FIG. 5 is a vertical sectional view of the projection lens. Additionally, in FIGS. 2A to 4B, an X axis is an axis which is parallel to the optical axis O, a Y axis is an axis that is vertical to the optical axis O and which extends in a left-to-right direction of the vehicle lamp 1, and a Z axis is an axis that is vertical to the optical axis O and which extends in a vertical direction of the vehicle lamp 1. In addition, in FIGS. 4A and 4B, lines are shown which represent outlines bounding the shape of the front surface 102 of the projection lens 100 in positions from an end portion lying at the front side of the vehicle lamp 1 (a front end portion) to an end portion lying at the rear side of the vehicle lamp 1 (a rear end portion) (hereinafter, these lines will be referred to as shape bounding outlines L as required). Additionally, FIG. 5 corresponds to a sectional view taken along a plane containing the optical axis O and the Z axis.

The projection lens 100 has the front surface 102, a side surface 104 and a rear surface 106. The projection lens 100 is configured so that light enters from the rear surface 106 and exits from the front surface 102. The side surface 104 is a surface which connects the front surface 102 and the rear surface 106 together.

When viewing the lamp unit 10 from the front, the front surface 102 of the projection lens 100 exhibits a substantially round shape which is centered at the optical axis O of the lamp unit 10 in a predetermined position 102*a* which lies closer to the front end portion. Additionally, when viewing the lamp unit 10 from the front, the front surface 102 exhibits a substantially non-round shape at the rear end portion 102*b*. Then, the front surface 102 changes in shape gradually from the substantially round shape to the substantially non-round shape as it extends from the predetermined position 102*a* to the rear end portion 102*b* in a region defined between the predetermined position 102*a* and the rear end portion 102*b* (hereinafter, this region is referred to as a rear region 102*c* as required). In this embodiment, the front surface 102 exhibits a hexagonal shape with rounded angles or corners at the rear end portion 102*b* as an example of a substantially non-round shape. Consequently, the outline of the front surface 102 changes in shape gradually from the substantially round shape towards the hexagonal shape with the rounded corners over the rear region 102*c*.

The shape bounding outlines L shown in FIGS. 4A and 4B correspond to lines which are formed by drawing imaginary straight lines in a radial fashion along the shape of the front surface 102 from the optical axis O towards the rear end portion 102*b* and connecting together points on the individual imaginary straight lines which lies equidistant in the front-to-rear direction of the vehicle lamp 1 from the front end portion of the projection lens 100. In the projection lens 100 according to this embodiment, the rear end portion 102*b* is positioned on a plane which intersects the optical axis O at right angles along a full circumference thereof. Namely, the outline bounding the shape of the rear end portion 102*b* is represented by a two-dimensional straight line or curve on a Y-Z plane. Consequently, the shape bounding outlines L shown in FIGS. 4A and 4B are equal to outlines bounding shapes of cross sections of the projection lens 100 taken along planes which are at right angles to the optical axis O.

Consequently, in the projection lens 100 of this embodiment, the shape of the cross sectional of the projection lens 100 which is at right angles to the optical axis O is the substantially round shape in the predetermined position 102*a* which is closer to the front end portion and the substantially non-round shape at the rear end portion, changing gradually from the substantially round shape towards the substantially non-round shape as the cross section of the projection lens 100 changes its position from the predetermined position 102*a* to the rear end portion 102*b*. In addition, in other words, in the front surface 102 of the projection lens 100 according to this embodiment, the shape of the outline bounding the cross section which is parallel to the plane which contains the full circumference of the rear end portion 102*b* is the substantially round shape in the predetermined position 102*a* and the substantially non-round shape at the rear end portion and changes gradually from the substantially round shape to the substantially non-round shape at it changes its position from the predetermined position 102*a* to the rear end portion 102*b*.

In this embodiment, the rear end portion 102*b* has the hexagonal shape, and therefore, the front surface 102 of the projection lens 100 has ridges 102*d* extending over the region defined from the rear end portion 102*b* to the predetermined position 102*a*, that is, the rear region 102*c*. On the other hand, the front surface 102 has no ridge over a region defined from the predetermined position 102*a* to the front end portion (hereinafter, referred to as a front region 102*e* as required). The shape of the outline bounding the cross section of the front surface 102 from the predetermined position 102*a* to the front end portion maintains the substantially round shape that is formed in the predetermined position 102*a* or changes to a shape which is rounder than the substantially round shape. For example, the shape of the outline bounding the cross section of the front surface 102 in the front region 102*e* changes gradually from the substantially round shape to the round shape as the cross section changes its position from the predetermined position 102*a* towards the front end portion.

Here, the "substantially round shape" means a shape of which the roundness is maintained to such an extent that, when a predetermined region 106*a* of the rear surface 106, which will be described later, is made into a flat surface or a convex surface (that is, when the predetermined region 106*a* has the same configuration as that of a related-art planoconvex or biconvex lens), light which exits from the front region 102*e* of the front surface 102 can form a rear focal point and extent that the shape of a light distribution pattern which is formed by light that passes through the rear focal point to enter the projection lens 100 and which exits from the front region 102*e* can satisfy a required accuracy. The "substantially round shape" includes a round shape. Additionally, the "substantially round shape" means a circle or round shape of which the roundness is 5% or less than a radius thereof. The "roundness" means the magnitude of a deviation from a circle whose circular shape is geometrically proper and is expressed by a difference in radius between two concentric geometrical circles which is generated in the event that a space between the two concentric geometrical circles becomes the least when a circular shape is held by the two concentric circles therebetween.

Additionally, the "substantially non-round shape" is shapes excluding the substantially round shape, and in this embodiment, the substantially non-round shape is the hexagonal shape with the rounded corners. However, the substantially non-round shape may be other polygonal shapes than the hexagonal shape or other shapes than the polygonal shapes such as elliptic shapes which deviate from the substantially round shape. In addition, the predetermined position 102*a* can be set as required based on experiments or simulations made by the designer. In setting the predetermined position 102*a*, for example, the accuracy of a shape or illuminance required for a light distribution pattern to be formed is taken into consideration. The predetermined position 102*a* is set, for example, within a range of ½, ⅓ or ⅕ of a side of the front surface 102 which lies at the front side of the vehicle lamp 1. Additionally, for example, the predetermined position 102*a* is a position where a plane that passes through a point on the optical axis O which is positioned within the range and that is parallel to the plane which contains the full circumference of the rear end portion 102*b* intersects the front surface 102.

The rear end portion 102*b* of the front surface 102 can take, for example, a hyperelliptic shape, a shape represented by a Lame curve or a shape represented by the following equation (1).

[Equation 1]

$$y=al\cos(4\phi/m)$$

$$x=bl\sin(4\phi/m) \tag{1}$$

$$\phi=\arctan(\sin^{2/r}(\theta)/\cos^{2/r}(\theta))$$

$$l=\sqrt{(\sin^{2/r}(\theta))^2+(\cos^{2/r}(\theta))^2}$$

(in the equation (1), m denotes an integer equal to or larger than 3, $r\geq 0.5$, $a>0$, and $b>0$)

In the equation (1), m denotes a number of corners of a figure formed. When m=4, the equation (1) is expressed by the following equation (2). In the equation (2), when a=b, the rear end portion 102*b* takes a shape called a so-called Squircle.

[Equation 2]

$$y=a\cos^{2/r}(\theta)$$

$$x=b\sin^{2/r}(\theta) \tag{2}$$

In the equations (1) and (2), it is possible to change a locus of a line connecting apexes which lie adjacent to each other by changing r. When r=2, the locus draws a round shape. Then, for example, the shape of the outline bounding the cross section of the front surface 102 in the predetermined position 102*a* can take a shape which is defined by making r=2, and the shape of the outline bounding the cross section of the front surface 102 in the rear region 102*c* can take a shape which is defined by changing r gradually as the outline changes its position from the predetermined position 102*a* towards the rear end portion 102*b*. In this embodiment, the shape of the outline bounding the cross section of the front surface 102 in the predetermined position 102*a*, that is, the shape of the outline bounding the cross section of the front surface 102 in a position which intersects the optical axis O at right angles takes a shape which is defined by making r=2 in the equation (1). In addition, the shape of the rear end portion 102*b* takes a shape which is defined by making m=6 and r=1.5 in the equation (1). Then, the shape of the outline bounding the cross section of the front surface 102 in the rear region 102*c* takes a shape which is defined by gradually reducing r from 2.0 to 1.5 as the outline changes its position from the predetermined position 102*a* towards the rear end portion 102*b*.

As shown in FIGS. 3A, 3B and 5, in the rear surface 106 of the projection lens 100, a predetermined region 106*a* (a region inside a broken line shown in FIGS. 3A and 3B) which contains a point of intersection P which intersects the optical axis O takes a substantially rotationally symmetric shape which is centered at the point of intersection P, and an outside region 106*b* of the predetermined region 106*a* (an outside region lying outside the broken line shown in FIGS. 3A and 3B) takes a shape defined by a free curved surface. Then, the projection lens 100 is designed so that light that passes through the rear focal point F to enter the predetermined region 106*a* of the rear surface 106 exits from the front region 102*e* of the front surface 102, while light that passes through the rear focal point F to enter the outside region 106*b* of the rear surface 106 exits emitted from the rear region 102*c* of the front surface 102.

Namely, the rear surface 106 of the projection lens 100 is designed so that when light substantially parallel to the optical axis O enters the front region 102*e* of the front surface 102, the light exits from the predetermined region 106*a* to converge to the rear focal point F and so that when light substantially parallel to the optical axis O enters the front surface 102 from the rear region 102*c*, the light exits from the outside region 106*b* to converge to the rear focal point F. The substantially rotationally symmetric shape of the predetermined region 106*a* which is centered at the point of intersection P means a shape of which the rotational symmetry is maintained to such an extent that the shape of a light distribution pattern that is formed by light that passes through the rear focal point F to enter the rear surface 106 from the predetermined region 106*a* and which exits from the front region 102*e* of the front surface 102 satisfies a required accuracy. The substantially rotationally symmetric shape includes a rotationally symmetric shape. The substantially rotationally symmetric shape is, for example, a plane which is normal to the optical axis O or a convex surface which is curved so as to project towards the rear focal point F.

The free curved surface of the outside region 106*b* of the rear surface 106 is designed as follows. Firstly, a direction in which light enters individual points in the projection lens to cause the light to exit from individual points on the rear region 102*c* at a target exit angle is calculated by using the Snell's Law. Then, an origin in generating a free curved surface is set in a predetermined position which lies further rearwards towards the rear of the vehicle lamp 1 than the individual points on a straight line which extends in the light entering direction. Then, a surface element which makes up part of a free curved surface is allocated to the origin. As this occurs, an angle formed by the straight line which extends in the light entering direction and a straight line which connects the rear focal point F and the origin is calculated. Then, an inclined angle of the surface element is calculated so as to obtain a refraction force amounting to the calculated angle by using the Snell's Law. By forming continuously adjacent surface elements in this way the free curved surface of the outside region 106*b* is generated.

Thus, as has been described heretofore, in the lamp unit 10 according to the embodiment, when looking at the lamp unit 10 from the front, the front surface 102 of the projection lens 100 takes the substantially round shape which is centered at the optical axis O in the predetermined position 102*a* which is closer to the front end portion and takes the substantially non-round shape at the rear end portion 102*b*. Additionally, the surface shape of the rear region 102*c* changes gradually from the substantially round shape to the substantially non-round shape as the rear region 102*c* changes its position from the predetermined position 102*a* towards the rear end portion 102*b*. Namely, although the projection lens 100 has the shape which differs from the related-art planoconvex or biconvex projection lens in the region lying close to the rear, the projection lens 100 takes the substantially round shape in the predetermined position 102*a* which lies closer to the front end portion. Therefore, the reduction in accuracy with which the light distribution of the lamp unit 10 is controlled can be suppressed which would otherwise be the case due to the projection lens 100 being formed into the anomalous lens. In addition, the rear end portion 102*b* of the front surface 102 takes the substantially non-round shape, and therefore, it is possible to increase the degree of freedom in layout of the lamp and vehicle design.

In addition, when looking at the lamp unit 10 from the front, the front surface 102 of the projection lens 100 takes the polygonal shape at the rear end portion 102*b*. The front surface 102 has the ridges 102*d* in the rear region 102*c* but has no ridge 102*d* in the front region 102*e*. Because of this, the exit direction of light which exits from the central region of the projection lens 100 can be controlled with high accuracy, and therefore, the accuracy with which the light distribution of the lamp unit 10 is controlled can be increased. In addition, it is possible to realize the novel design in which the intense polygonal lines (ridges) are generated towards the peripheral portion of the projection lens 100 when looking at the lamp unit 10 from the front.

Additionally, in the rear surface 106 of the projection lens 100, the predetermined region 106*a* which includes the point of intersection P which intersects the optical axis O takes the substantially rotationally symmetric shape which is centered at the point of intersection P or the optical axis O, and the outside region 106*b* takes the shape defined by the free curved surface. Then, the projection lens 100 is designed so that light that passes through the rear focal point F to enter the predetermined region 106*a* exits from the front region 102*e* of the front surface 102 and so that light that passes through the rear focal point F to enter the outside region 106*b* exits from the rear region 102*c* of the front surface 102. By this design, the rear region 102*c* of the front surface 102 which has the shape which differs from that of the related-art projection lens can also be used to form the light distribution pattern. Additionally, a desired light distribution pattern can be formed with good accuracy by using the light that exists from the rear region 102*c*.

Second Embodiment

A lamp unit according to the second embodiment includes a configuration which is similar to that of the lamp unit according to the first embodiment excluding that a projection lens has a different shape. Hereinafter, the lamp unit of this embodiment will be described based mainly on the different feature. It should be noted that like reference numerals will be given to like configurations to those of the first embodiment, and the description and illustration thereof will be omitted here.

Figure 6A:
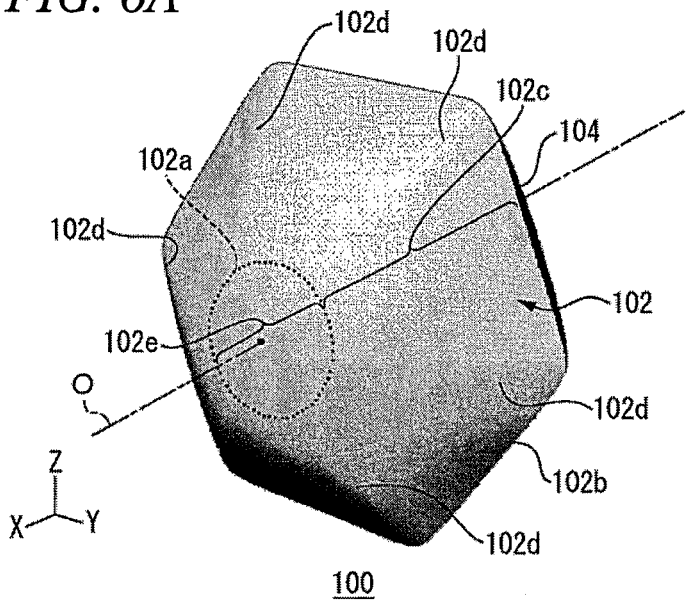
FIG. 6A is a perspective view of a projection lens provided in a lamp unit according to a second embodiment as seen from the front of a vehicle lamp.
Figure 6B:
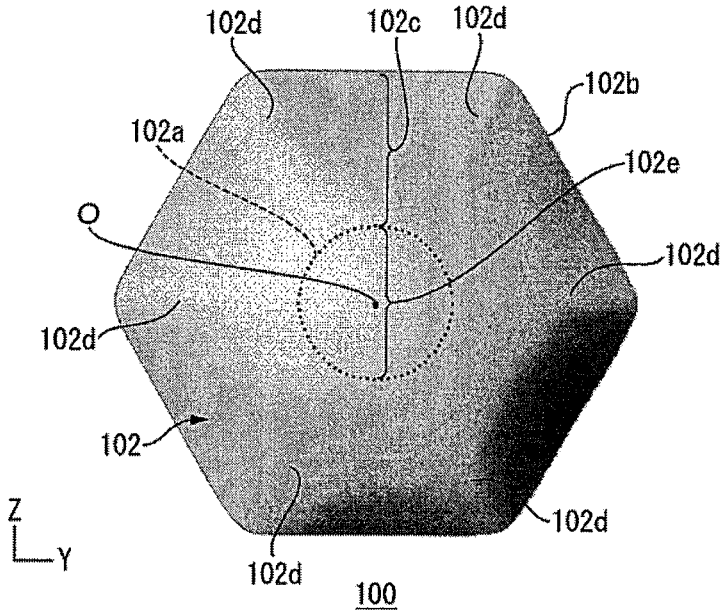
FIG. 6B is a front view of the projection lens.
Figure 7A:
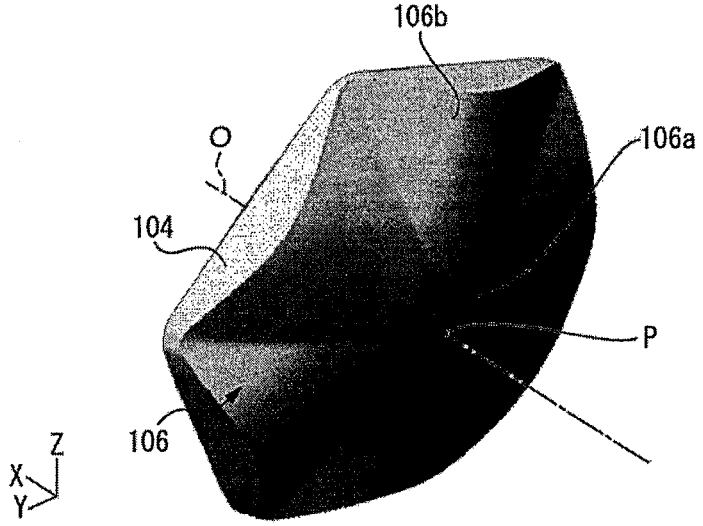
FIG. 7A is a perspective of the projection lens as seen from the rear of the vehicle lamp.
Figure 7B:
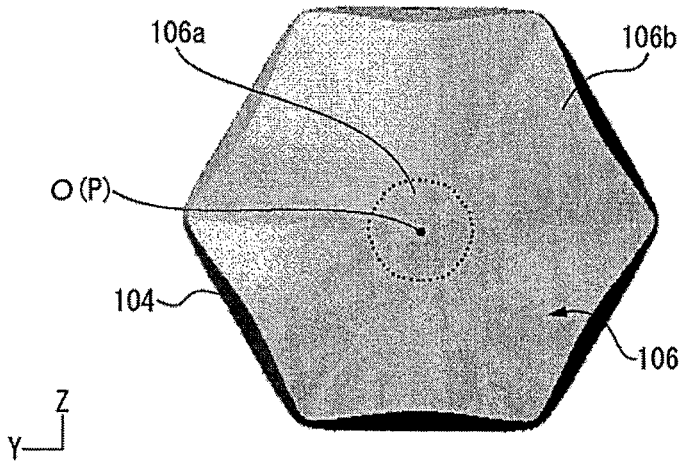
FIG. 7B is a rear view of the projection lens.
Figure 8A:
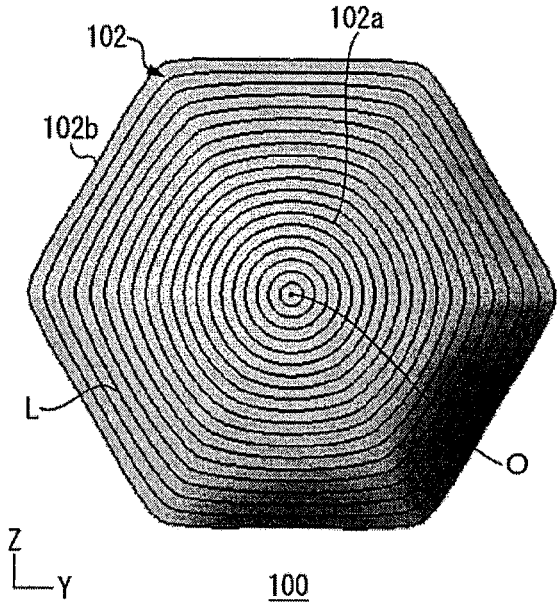
FIG. 8A is a front view of the projection lens which describes the shape of a front surface of the projection lens.
Figure 8B:
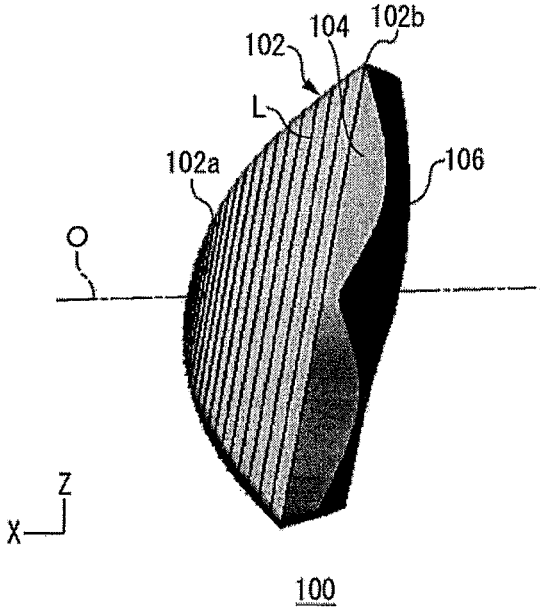
FIG. 8B is a side view of the projection lens which describes the shape of the front surface of the projection lens.
Figure 9:
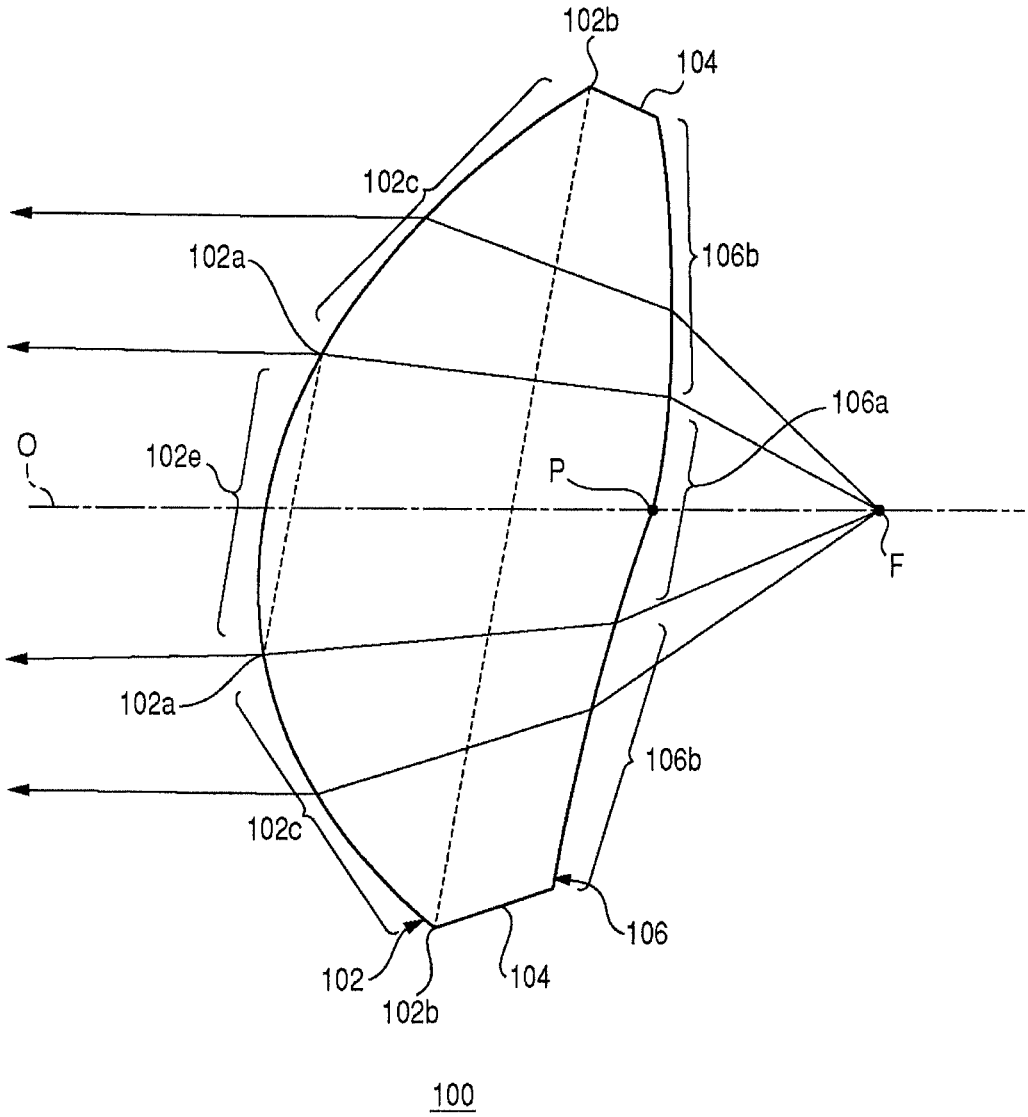
FIG. 9 is a vertical sectional view of the projection lens.

FIG. 6A is a perspective view of a projection lens provided in the lamp unit according to the second embodiment as seen from the front of a vehicle lamp 1. FIG. 6B is a front view of the projection lens. FIG. 7A is a perspective of the projection lens as seen from the rear of the vehicle lamp 1. FIG. 7B is a rear view of the projection lens. FIG. 8A is a front view of the projection lens which describes the shape of a front surface of the projection lens. FIG. 8B is a side view of the projection lens which describes the shape of the front surface of the projection lens. FIG. 9 is a vertical sectional view of the projection lens.

A projection lens 100 has a front surface 102, a side surface 104 and a rear surface 106. When looking at a lamp unit 10 from the front thereof, the front surface 102 exhibits a substantially round shape which is centered at an optical axis O of the lamp unit 10 in a predetermined position 102*a* which lies closer to a front end portion. Additionally, when looking at the lamp unit 10 from the front, the front surface 102 exhibits a substantially non-round shape at a rear end portion 102*b*. In addition, the front surface 102 changes gradually its shape from the substantially round shape to the substantially non-round shape in a rear region 102*c* as the front surface 102 extends from the predetermined position 102*a* to the rear end portion 102*b*. In this embodiment, the front surface 102 exhibits a hexagonal shape with rounded angles or corners at the front end portion 102*b*. Because of this, the front surface 102 has ridges 102*d* in the rear region 102*c*. On the other hand, the front surface 102 has no ridge 102*d* in a front region 102*e*.

In the projection lens 100 of this embodiment, a plane containing a full circumference of the rear end portion 102*b* has a shape which is inclined obliquely relative to the optical axis O. In addition, the shape of the front surface 102 is set as follows. Namely, in a similar way to that of the first embodiment, the shape of an imaginary end portion is determined based on the equation (1). This imaginary end portion is contained in a plane which intersects the optical axis O at right angles along a full circumference thereof. Then, by changing gradually r in the equation (1) as the front surface 102 extends from the initial position 102*a* towards the rear end portion 102*b*, the shape of imaginary shape bounding outlines is changed gradually from the substantially round shape in the predetermined position 102*a* towards the substantially non-round shape at the rear end portion 102*b*. Then, the imaginary end portion is inclined on the optical axis O to constitute the rear end portion 102*b*, and the imaginary shape bounding outlines are inclined on the optical axis O so as to be parallel to the rear end portion 102*b* to thereby constitute shape bounding outlines L (refer to FIGS. 8A and 8B). Thus, the shape of a surface of the rear region 102*c* is determined.

Consequently, in the front surface 102 of the projection lens 100 according to this embodiment, the shape of the outline bounding the cross section parallel to the plane which contains the full circumference of the rear end portion 102*b* is the substantially round shape in the predetermined position 102*a* and the substantially non-round shape at the rear end portion 102*b* and changes gradually from the substantially round shape to the substantially non-round shape over the region from the predetermined position 102*a* to the rear end portion 102*b*. It should be noted that the inclination of the rear end portion 102*b* is set so that the substantially round shape of the front surface 102 in the predetermined position 102*a* which results when looking at the lamp unit 10 from the front is maintained.

In the projection lens 100 of this embodiment, the rear end portion 102*b* is positioned on the plane which is inclined relative to the optical axis O. Namely, the shape of the outline of the rear end portion 102*b* is represented by a three-dimensional straight line or curve. It should be noted that the shape of the rear end portion 102*b* may be a three-dimensional shape in which the full circumference of the rear end portion 102*b* is not positioned on the same plane.

As shown in FIGS. 7A, 7B and 8, in the rear surface 106 of the projection lens 100, a predetermined region 106*a* which contains a point of intersection P which intersects the optical axis O is a substantially rotationally symmetric shape which is centered at the point of intersection P, and an outside region 106*b* of the predetermined region 106*a* is a shape defined by a free curved surface. Then, the projection lens 100 is designed so that light passes through a rear focal point F to enter the predetermined region 106*a* exits from a front region 102*e* of the front surface 102 and so that light that passes through the rear focal point F to enter the outside region 106*b* exits from the rear region 102*c* of the front surface 102.

Thus, the advantage similar to that of the first embodiment can also be obtained by the lamp unit 10 according to the second embodiment.

Third Embodiment

A lamp unit according to the third embodiment includes a configuration which is similar to that of the lamp unit according to the first embodiment excluding that a projection lens has a different shape. Hereinafter, the lamp unit of this embodiment will be described based mainly on the different feature. It should be noted that like reference numerals will be given to like configurations to those of the first embodiment, and the description and illustration thereof will be omitted here.

Figure 10A:
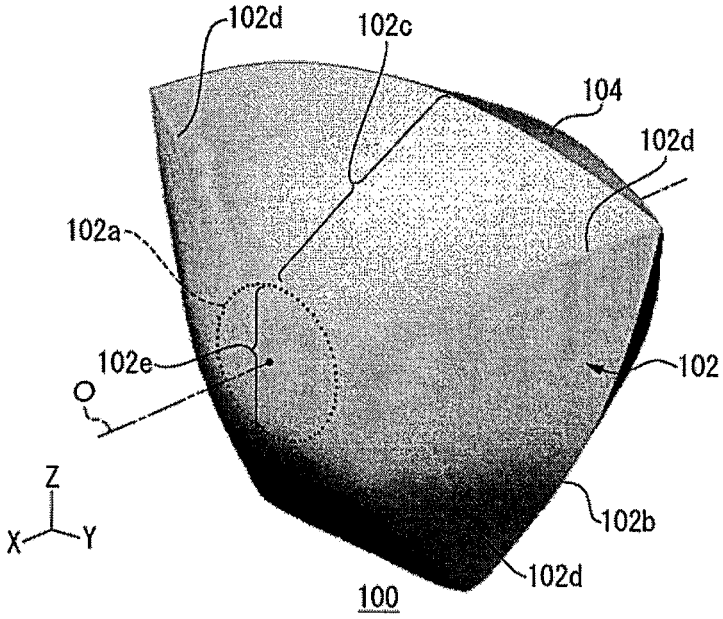
FIG. 10A is a perspective view of a projection lens provided in a lamp unit according to a third embodiment as seen from the front of a vehicle lamp 1.
Figure 10B:
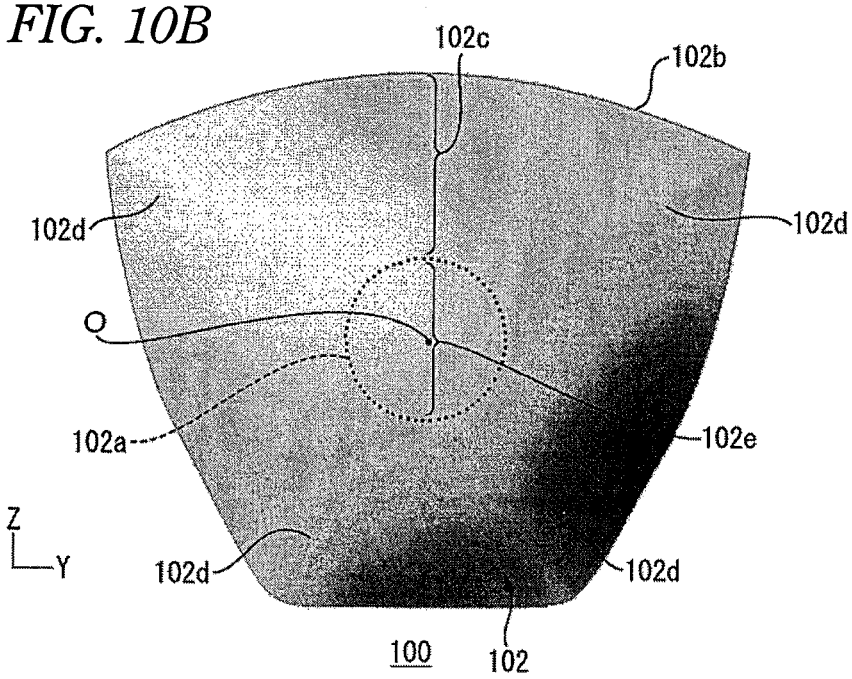
FIG. 10B is a front view of the projection lens.
Figure 11A:
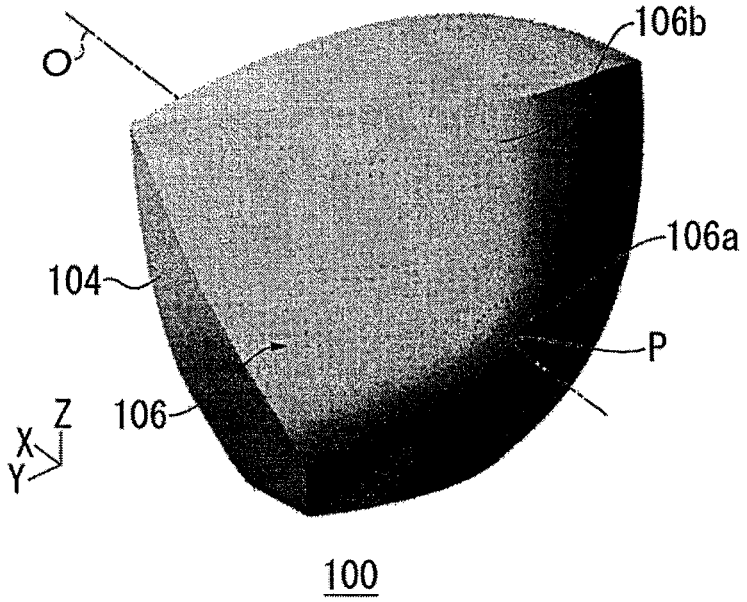
FIG. 11A is a perspective of the projection lens as seen from the rear of the vehicle lamp.
Figure 11B:
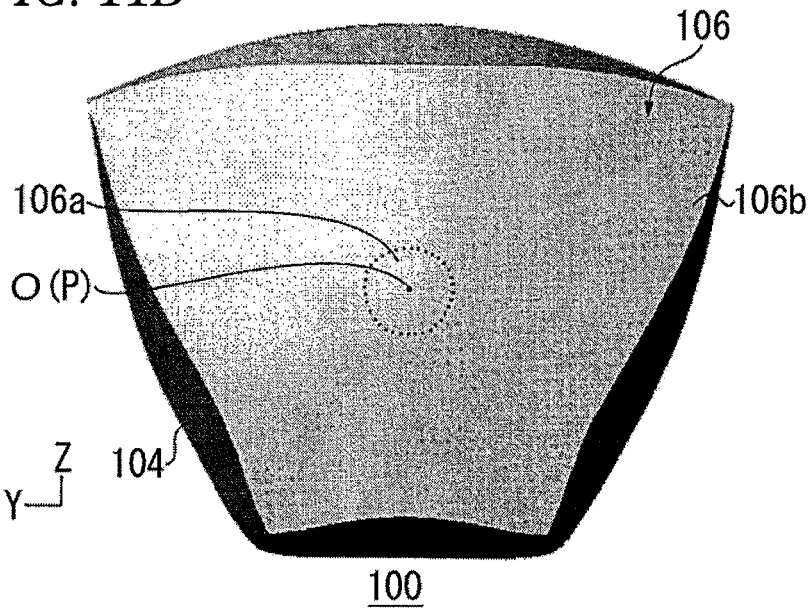
FIG. 11B is a rear view of the projection lens.
Figure 12A:
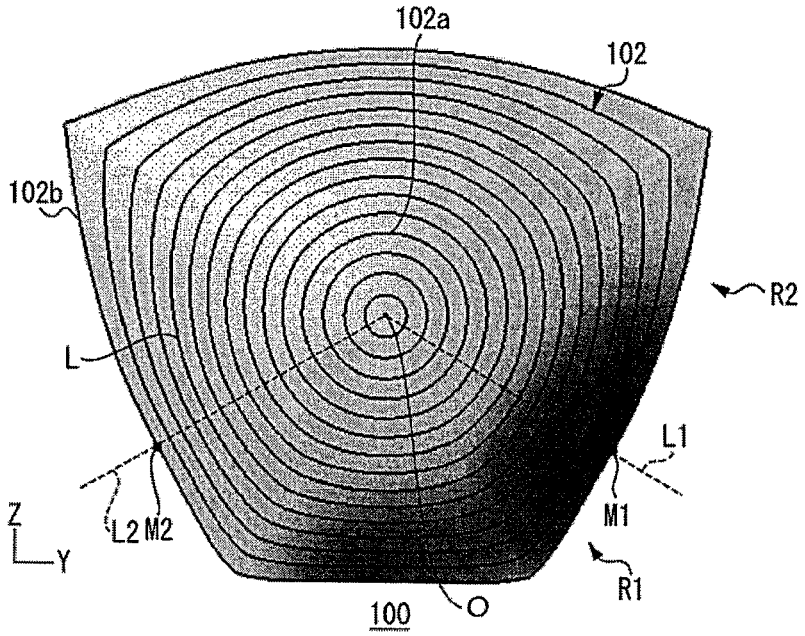
FIG. 12A is a front view of the projection lens which describes the shape of a front surface of the projection lens.
Figure 12B:
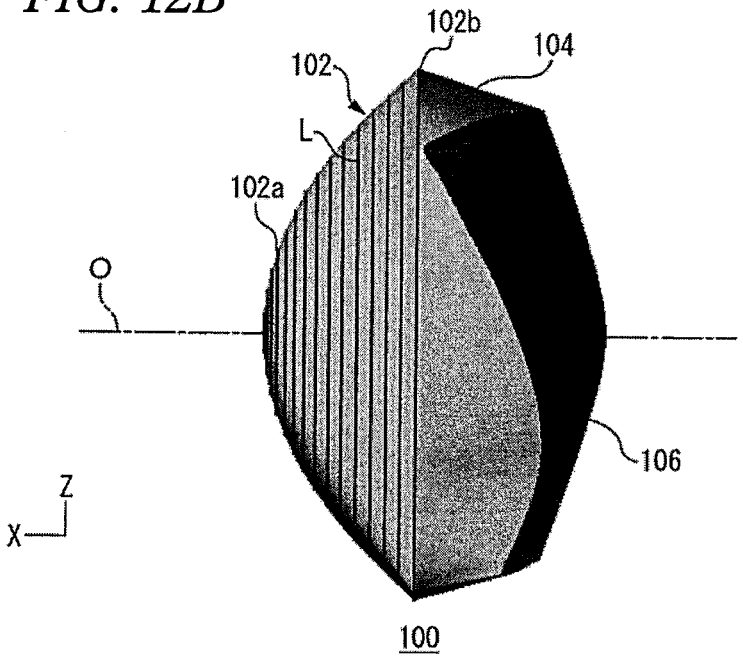
FIG. 12B is a side view of the projection lens which describes the shape of the front surface of the projection lens.
Figure 13:
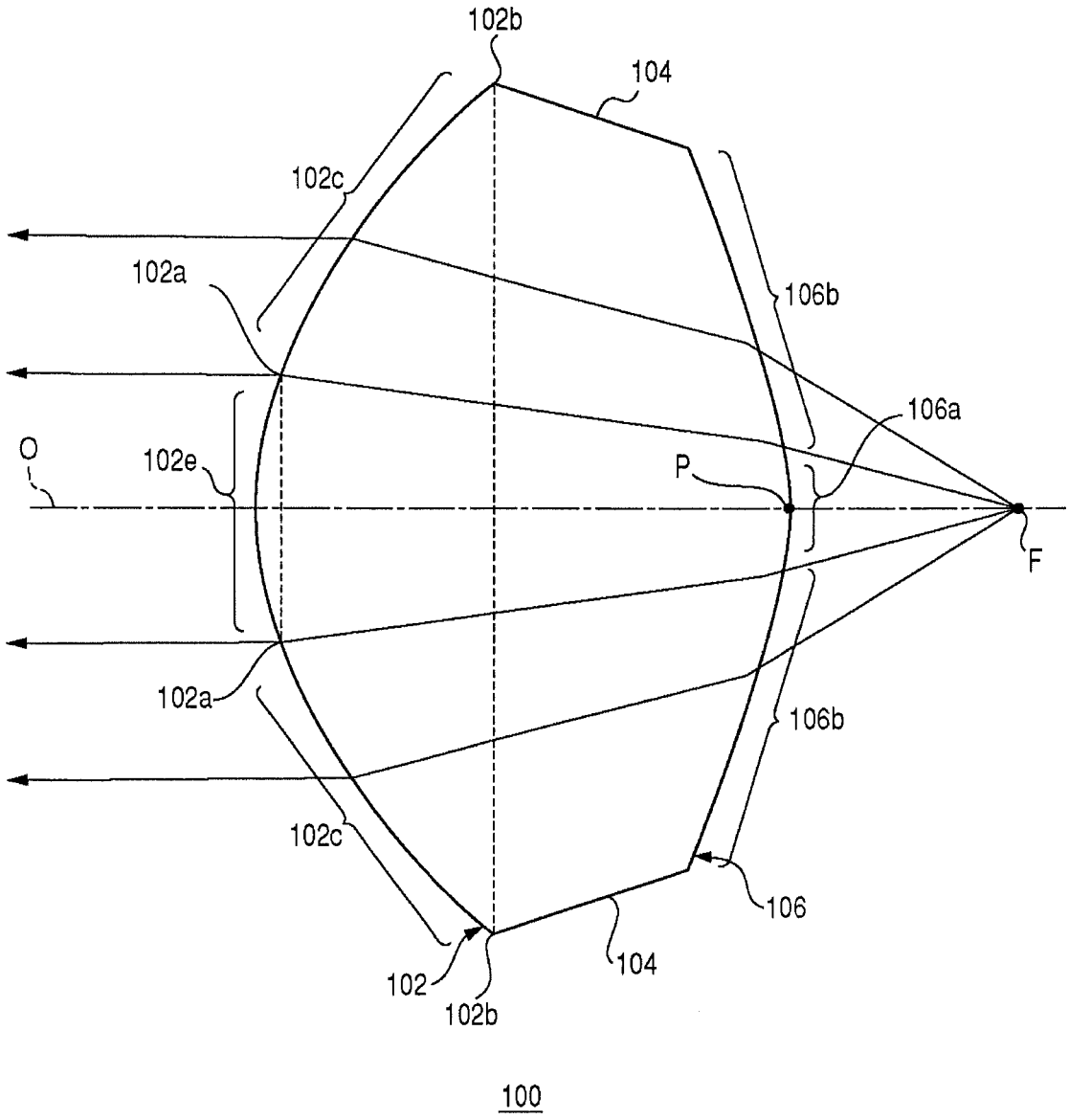
FIG. 13 is a vertical sectional view of the projection lens.

FIG. 10A is a perspective view of a projection lens provided in the lamp unit according to the third embodiment as seen from the front of a vehicle lamp 1. FIG. 10B is a front view of the projection lens. FIG. 11A is a perspective of the projection lens as seen from the rear of the vehicle lamp 1. FIG. 11B is a rear view of the projection lens. FIG. 12A is a front view of the projection lens which describes the shape of a front surface of the projection lens. FIG. 12B is a side view of the projection lens which describes the shape of the front surface of the projection lens. FIG. 13 is a vertical sectional view of the projection lens.

A projection lens 100 has a front surface 102, a side surface 104 and a rear surface 106. When looking at a lamp unit 10 from the front thereof, the front surface 102 exhibits a substantially round shape which is centered at an optical axis O of the lamp unit 10 in a predetermined position 102*a* which lies closer to a front end portion. Additionally, when looking at the lamp unit 10 from the front, the front surface 102 exhibits a substantially non-round shape at a rear end portion 102*b*. In addition, the front surface 102 changes gradually its shape from the substantially round shape to the substantially non-round shape in a rear region 102*c* as the front surface 102 extends from the predetermined position 102*a* to the rear end portion 102*b*. In this embodiment, the rear end portion 102*b* has a substantially trapezoidal shape with each side curved outwards. Because of this, the front surface 102 has ridges 102*d* in the rear region 102*c*. On the other hand, the front surface 102 has no ridge 102*d* in a front region 102*e*.

In the projection lens 100 of this embodiment, the rear end portion 102*b* of the front surface 102 is formed by a combination of a plurality of lines of different types which are defined by the equation (1). In this embodiment, firstly, as shown in FIG. 12A, a change point M1 and a change point M2 are set in predetermined positions on the rear end portion 102*b*. The change point M1 corresponds to a point of intersection between a reference line L1 which is inclined 30 degrees in a clockwise direction relative to a Y axis and the rear end portion 102*b*. The change point M2 corresponds to a point of intersection between a reference line L2 which is inclined 120 degrees in the clockwise direction relative to the reference line L1 and the rear end portion 102*b*. A portion (a portion extending along a lower side of the projection lens 100 from the change point M1 to the change point M2) of the rear end portion 102*b* which is included in a region R1 that includes the lower side of the projection lens 100 and which is defined from the reference line L1 to the reference line L2 constitutes part of a line which is defined by making m=6 and r=1.8 in the equation (1). In addition, a portion (extending along an upper side of the projection lens 100 from the reference line L1 to the reference line L2) of the rear end portion 102*b* which is included in a region R2 that includes the upper side of the projection lens 100 and which is defined from the reference line L1 to the reference line L2 constitutes part of a line which is defined by making m=3 and r=1.0 in the equation (1).

As to the shape of a surface of the rear region 102*c*, a surface of the region R1 takes a shape which is defined by increasing r in the equation (1) from 1.8 to 2.0 as the surface approaches the predetermined position 102*a*. In addition, a surface of the region R2 takes a shape which is defined by increasing r in the equation (1) from 1.0 to 2.0 as the surface approaches the predetermined position 102*a*. Lines positioned on planes which intersect the optical axis O at right angles in the region R1 and lines positioned on the planes which intersect the optical axis O at right angles in the region R2 can be connected smoothly at the change point M1 and the change point M2. It should be noted that the types and numbers of lines that are combined together and the ranges over which the lines extend can be set as required.

As shown in FIGS. 11A, 11B and 13, in the rear surface 106 of the projection lens 100, a predetermined region 106*a* which contains a point of intersection P which intersects the optical axis O is a substantially rotationally symmetric shape which is centered at the point of intersection P, and an outside region 106*b* of the predetermined region 106*a* is a shape defined by a free curved surface. Then, the projection lens 100 is designed so that light passes through a rear focal point F to enter the predetermined region 106*a* exits from a front region 102*e* of the front surface 102 and so that light that passes through the rear focal point F to enter the outside region 106*b* exits from the rear region 102*c* of the front surface 102.

Thus, the advantage similar to that of the first embodiment can also be obtained by the lamp unit 10 according to the third embodiment.

Fourth Embodiment

A lamp unit according to the fourth embodiment includes a configuration which is similar to that of the lamp unit according to the first embodiment excluding that a projection lens has a different shape. Hereinafter, the lamp unit of this embodiment will be described based mainly on the different feature. It should be noted that like reference numerals will be given to like configurations to those of the first embodiment, and the description and illustration thereof will be omitted here.

Figure 14A:
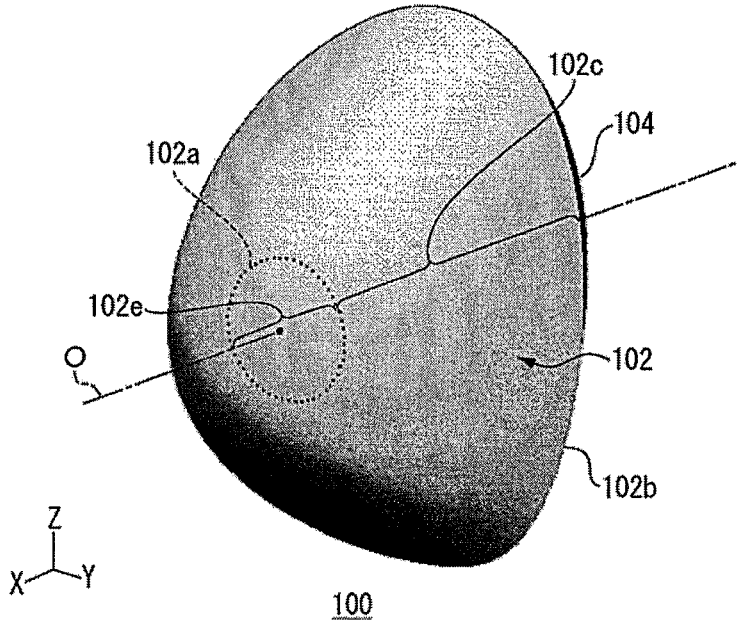
FIG. 14A is a perspective view of a projection lens provided in a lamp unit according to a fourth embodiment as seen from the front of a vehicle lamp 1.
Figure 14B:
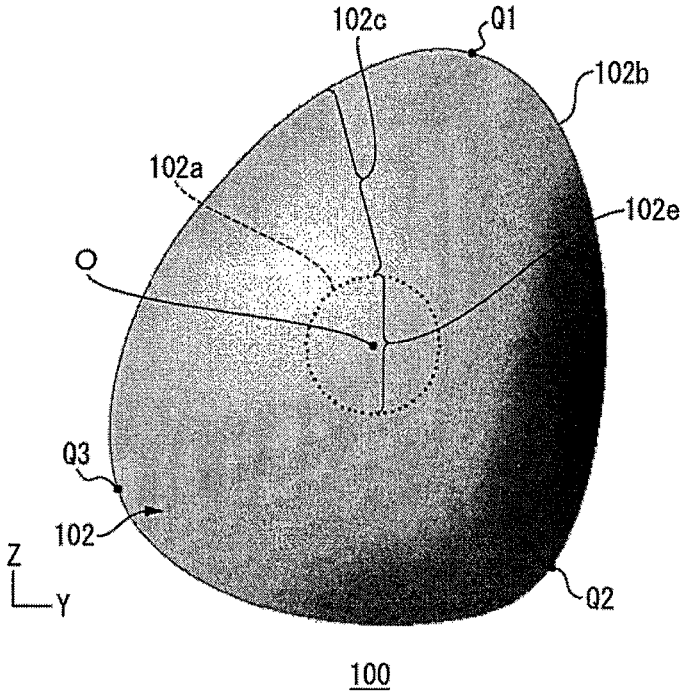
FIG. 14B is a front view of the projection lens.
Figure 15A:
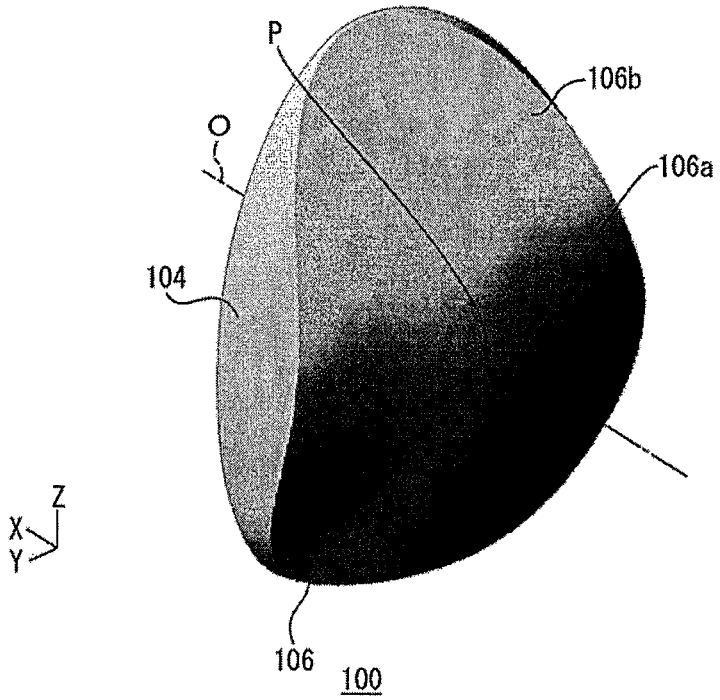
FIG. 15A is a perspective of the projection lens as seen from the rear of the vehicle lamp.
Figure 15B:
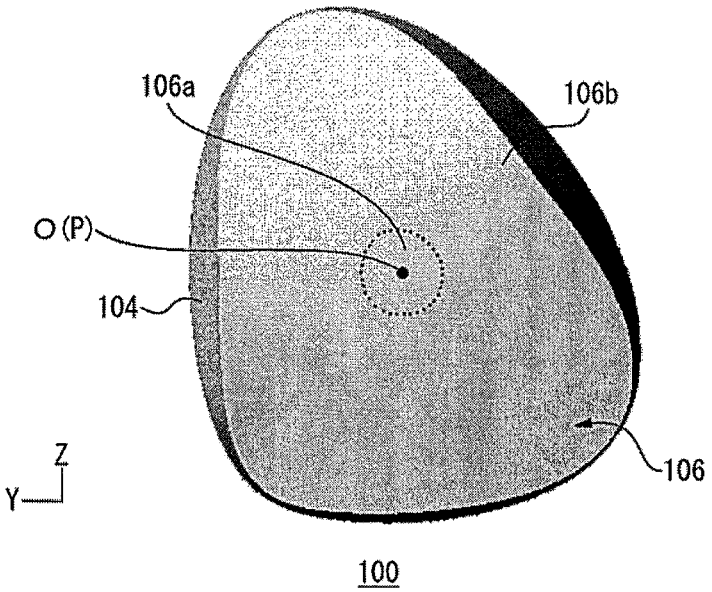
FIG. 15B is a rear view of the projection lens.
Figure 16A:
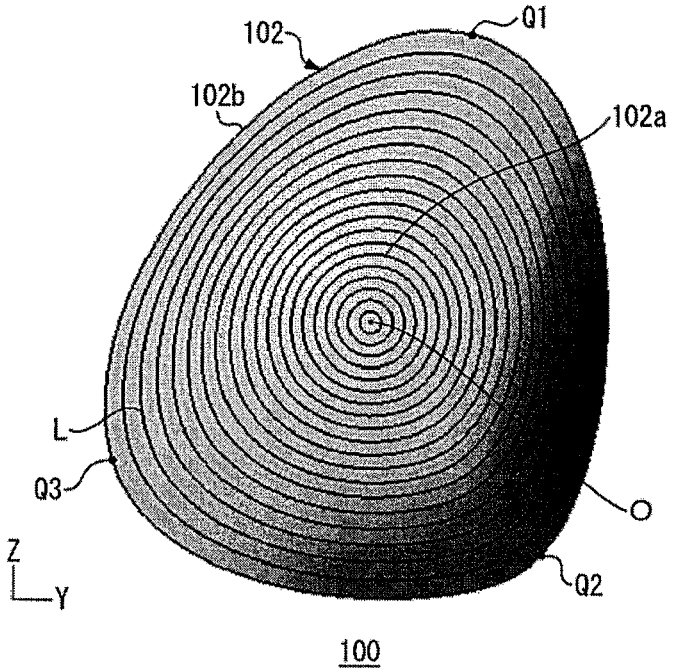
FIG. 16A is a front view of the projection lens which describes the shape of a front surface of the projection lens.
Figure 16B:
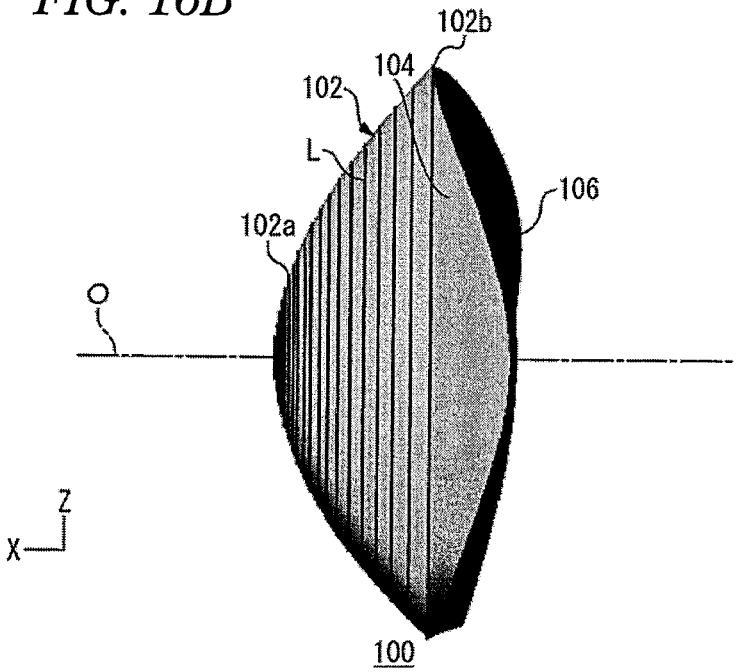
FIG. 16B is a side view of the projection lens which describes the shape of the front surface of the projection lens.
Figure 17:
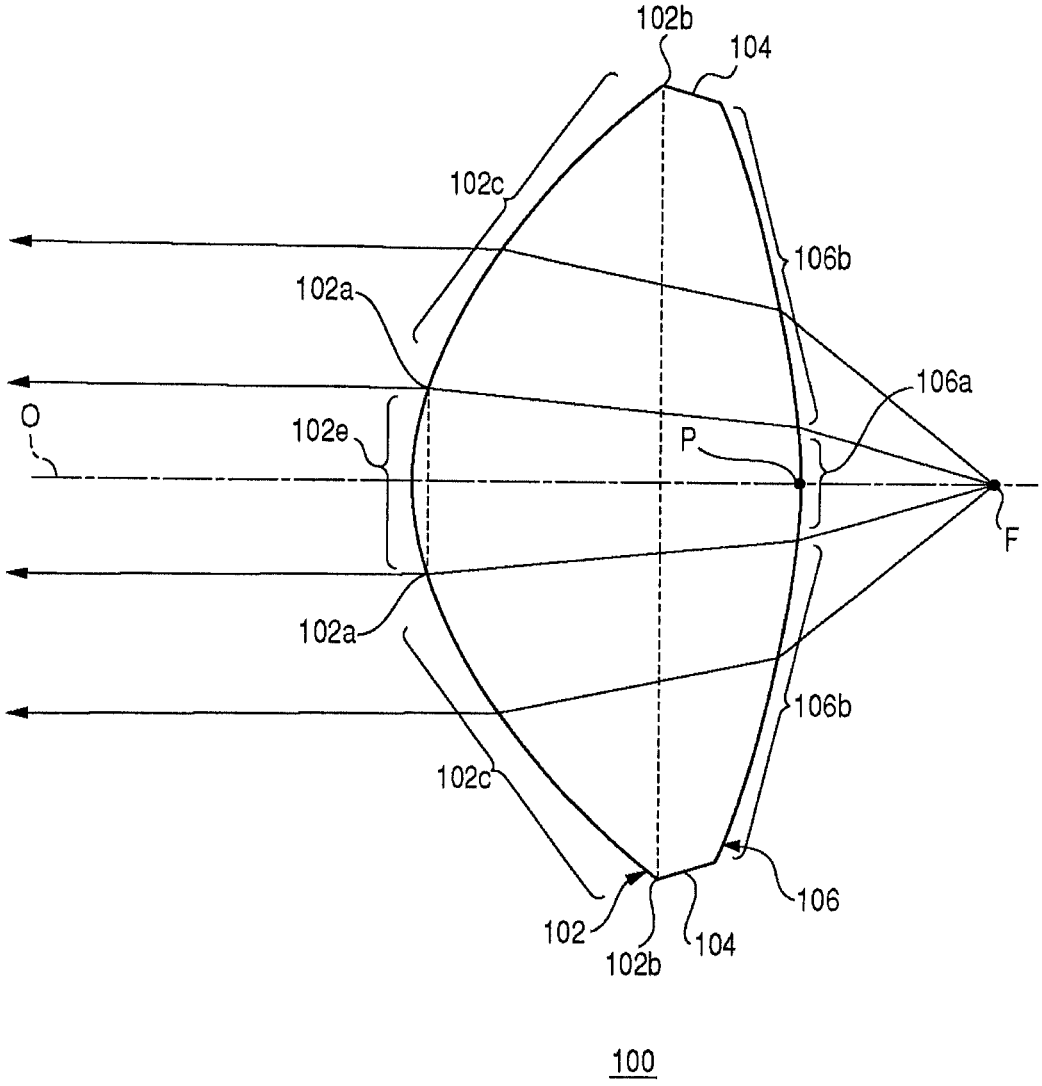
FIG. 17 is a vertical sectional view of the projection lens.

FIG. 14A is a perspective view of a projection lens provided in the lamp unit according to the fourth embodiment as seen from the front of a vehicle lamp 1. FIG. 14B is a front view of the projection lens. FIG. 15A is a perspective of the projection lens as seen from the rear of the vehicle lamp 1. FIG. 15B is a rear view of the projection lens. FIG. 16A is a front view of the projection lens which describes the shape of a front surface of the projection lens. FIG. 16B is a side view of the projection lens which describes the shape of the front surface of the projection lens. FIG. 17 is a vertical sectional view of the projection lens.

A projection lens 100 has a front surface 102, a side surface 104 and a rear surface 106. When looking at a lamp unit 10 from the front thereof, the front surface 102 exhibits a substantially round shape which is centered at an optical axis O of the lamp unit 10 in a predetermined position 102*a* which lies closer to a front end portion. Additionally, when looking at the lamp unit 10 from the front, the front surface 102 exhibits a substantially non-round shape at a rear end portion 102*b*. In addition, the front surface 102 changes gradually its shape from the substantially round shape to the substantially non-round shape in a rear region 102*c* as the front surface 102 extends from the predetermined position 102*a* to the rear end portion 102*b*.

In the projection lens 100 of this embodiment, reference points are set which constitute apexes, and curves are set which connect the reference points, whereby a rear end portion 102*b* is formed. Each curve connecting the reference points is, for example, a spline curve and is set to connect to the adjacent curve in a smooth fashion. In this embodiment, three reference points Q1, Q2, Q3 are set. It should be noted that the shape of the rear end portion 102*b* may be determined based on the equation (1). Additionally, the overall shape of the front surface 102 is formed by combining a base shape A and a base shape B. The base shape A is a round shape which is centered at the optical axis O, and the base shape B is the shape of the rear end portion 102*b*. Hereinafter, a method for setting the shape of the front surface 102 will be described in detail.

Figure 18C:
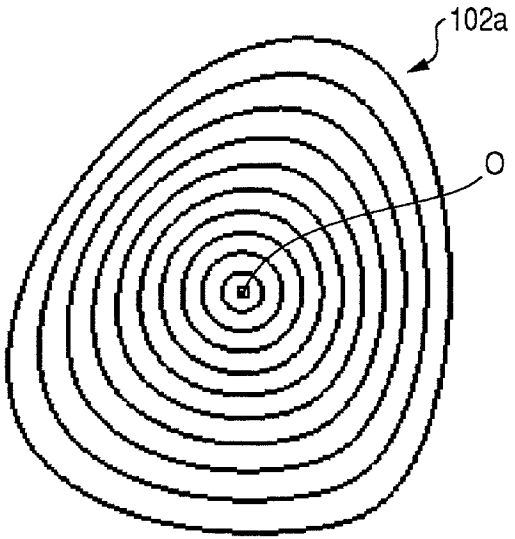
FIGS. 18A to 18C are diagrams which describe a method for setting the shape of the front surface.
Figure 18B:
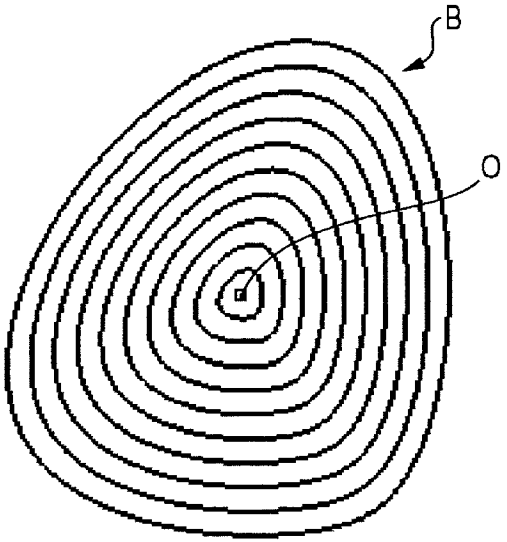
Figure 18A:
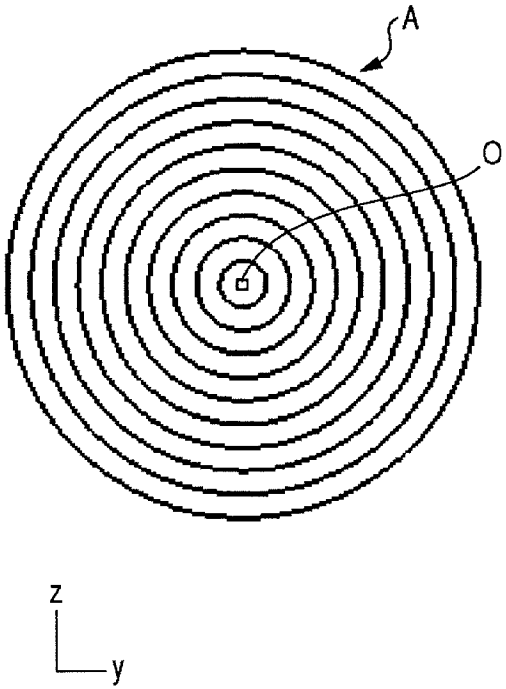
Figure 19:
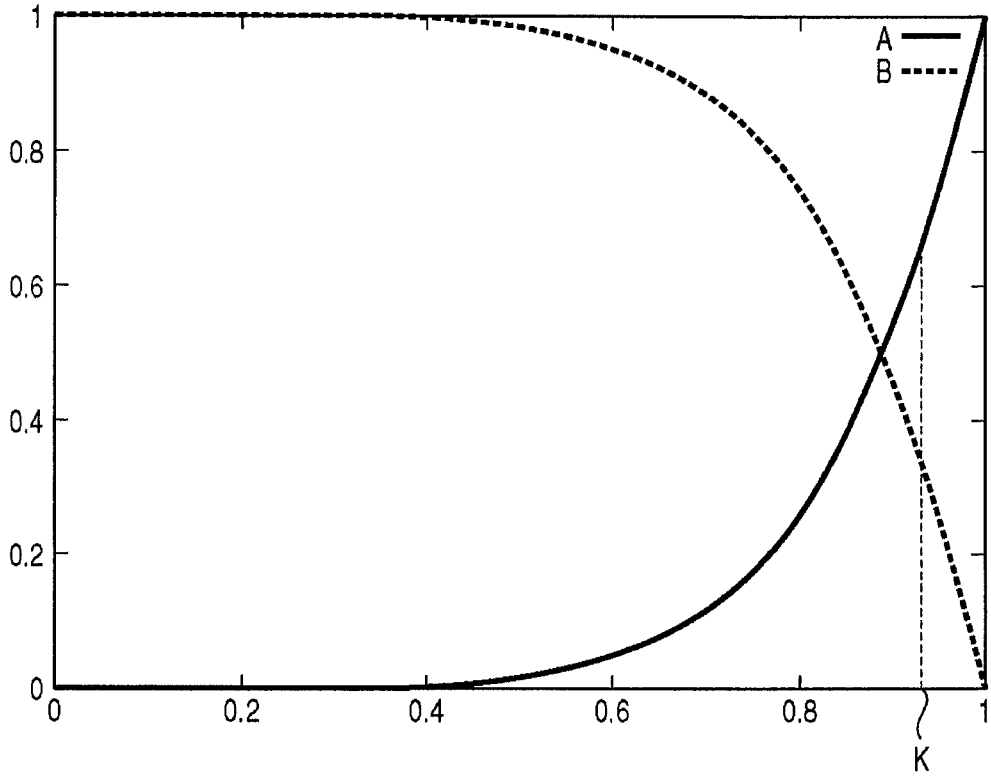
FIG. 19 is a graph showing a relation between a ratio of mixing the base shapes which determines the front surface of the projection lens and the position of the projection lens in a front-to-rear direction of the vehicle lamp.

FIGS. 18A to 18C are diagrams which describe a method for setting the shape of the front surface. FIG. 19 is a graph showing a relation between a ratio of mixing the base shapes which determines the front surface of the projection lens and the position of the projection lens in a front-to-rear direction of the vehicle lamp 1. FIG. 18A shows the base shape A, FIG. 18B shows the base shape B, and FIG. 18C shows the shape of the front surface 102 which is obtained as a result of the base shape A and the base shape B being mixed together. In addition, in FIG. 19, an axis of ordinates denotes a mixing ratio of the base shapes (the magnitude of a mixing factor), and an axis of abscissas denotes a distance from the rear end portion 102*b* to a front end portion of the front surface 102 in the front-to-rear direction of the vehicle lamp 1. In the axis of abscissas, 0 denotes the position of the rear end portion 102*b*, and 1 denotes the position of the front end portion. In addition, a solid line denotes the base shape A, and a broken line denotes the base shape B.

As shown in FIG. 19, the mixing ratio of the base shape B (refer to FIG. 18B) is 100% (an axis of ordinates 1) at the rear end portion 102*b* (an axis of abscissas 0) of the front surface 102. In addition, the base shape B is dominant in a region of the front surface 102 which lies at the rear of the vehicle lamp 1. Then, the mixing ratio of the base shape A (refer to FIG. 18A) is increased gradually towards a region of the front surface 102 which lies at the front of the vehicle lamp 1, while the mixing ratio of the base shape B is decreased. The mixing ratio of the base shape A is 100% at the front portion (an axis of abscissas 1) of the front surface 102.

More specifically, the mixing ratio of the base shape A starts to increase (the mixing ratio of the base shape B starts to decrease) from a position (the position of 0.4 on the axis of abscissas) on the front surface 102 which lies further rearwards towards the rear of the vehicle lamp 1 than a middle position and increases in an exponentially functional fashion (decreases in an exponentially functional fashion) towards the front end portion. Then, the mixing ratio of the base shape A to the base shape B becomes 1:1 in a position located 90% of the front surface 102 forwards towards the front of the vehicle lamp 1 from the rear end portion, and the mixing ratio of the base shape A becomes 100% and the mixing ratio of the base shape B becomes 0% at the front end portion. A position denoted by K in FIG. 19 corresponds to the predetermined position 102*a*. In this way, the shape of the front surface 102 (refer to FIG. 18C) is designed so as to change gradually from the substantially round shape to the substantially non-round shape in the rear region 102*c* as the front surface 102 changes its position from the predetermined position 102*a* to the rear end portion 102*b*. It should be noted that the type of the base shape B and the transition of mixing ratio thereof can be set as required.

As shown in FIGS. 15A, 15B and 17, in the rear surface 106 of the projection lens 100, a predetermined region 106*a* which contains a point of intersection P which intersects the optical axis O is a substantially rotationally symmetric shape which is centered at the point of intersection P, and an outside region 106*b* of the predetermined region 106*a* is a shape defined by a free curved surface. Then, the projection lens 100 is designed so that light passes through a rear focal point F to enter the predetermined region 106*a* exits from a front region 102*e* of the front surface 102 and so that light that passes through the rear focal point F to enter the outside region 106*b* exits from the rear region 102*c* of the front surface 102.

Thus, the advantage similar to that of the first embodiment can also be obtained by the lamp unit 10 according to the fourth embodiment.

The invention is not limited to the embodiments, and hence, the embodiments can be combined or modifications such as various design changes can be made to the embodiments based on the knowledge of those skilled in the art. Embodiments based on these combinations or modifications are also included in the scope of the invention. New embodiments produced by the combinations of the embodiments that have been described heretofore or combinations of the embodiments described above with the following modified example come to have the respective advantages of the embodiments and the modified example to be combined.

Modified Example

A lamp unit according to a modified example includes a configuration similar to those of the lamp units according to Embodiments 1 to 4 excluding that the lamp unit is a so-called direct projection lamp unit. Hereinafter, the lamp unit according to this modified example will be described based mainly on the different feature from Embodiments 1 to 4. It should be noted that like reference numerals will be given to like configurations to those of Embodiments 1 to 4 and the description and illustration thereof will be omitted here.

Figure 20:
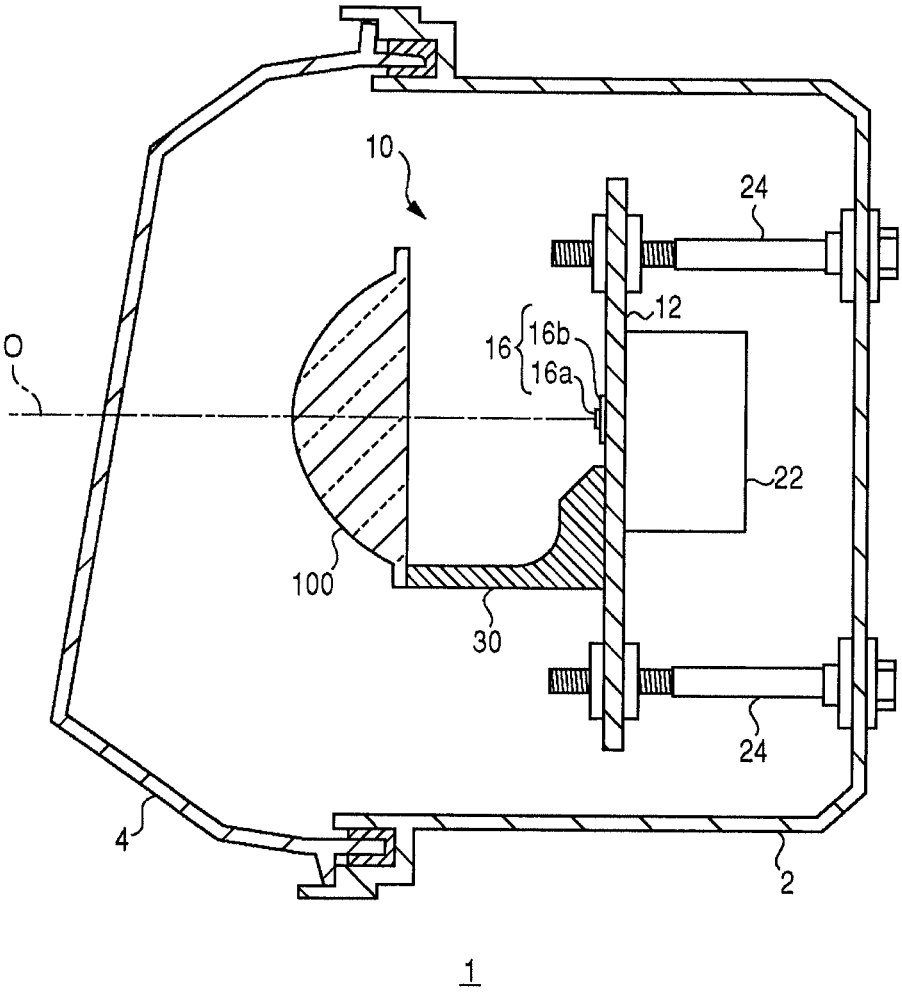
FIG. 20 is a vertical sectional view which shows exemplarily a schematic construction of a vehicle lamp in which a lamp unit according to the modified example is mounted.

FIG. 20 is a vertical sectional view which shows exemplarily a schematic construction of a vehicle lamp in which the lamp unit according to the modified example is mounted. As shown in FIG. 20, a vehicle lamp 1 includes a lamp body 2 and a transparent cover 4. A lamp unit 10 is accommodated in a lamp chamber 3 which is defined by the lamp body 2 and the transparent cover 4.

The lamp unit 10 of the modified example is a so-called direct projection lamp unit and includes a bracket portion 12, a light source module 16, a lens holder 30 and a projection lens 100. The bracket portion 12 is a substantially plate-shaped member and is disposed so that main surfaces are directed in a front-to-rear direction of the vehicle lamp 1. In this modified example, the bracket portion 12 also functions as a light source mounting portion, and the light source module 16 is mounted on a main surface which is oriented towards a front side of the vehicle lamp 1. A heat dissipating fin 22 is fixed to a main surface of the bracket portion 12 which is oriented towards a rear side of the vehicle lamp 1. The bracket portion 12 has screw holes in predetermined positions of a peripheral edge portion thereof, and aiming screws 24 which penetrate the lamp body 2 to project to the front are screwed in the screw holes. By doing so, the bracket portion 12 is mounted on the lamp body 2. It should be noted that the shape of the bracket portion 12 is not particularly limited thereto.

The light source module 16 is disposed so that a light exit surface is oriented to the front of the lamp unit 1. The light source module 16 has a light emitting element 16*a* and a substrate 16*b* which supports the light emitting element 16*a*. Heat generated from the light source module 16 is transmitted to the heat dissipating element 22 via the bracket portion 12.

The lens holder 30 is fixed to the main surface of the bracket portion 12 which lies at the front side of the vehicle lamp 1. The lens holder 30 projects towards the front of the vehicle lamp 1, and the projection lens 100 is fixed to a distal end of the lens holder 30. The projection lens 100 is disposed on the optical axis O of the lamp unit 10 so that a rear focal point thereof coincides substantially with the light emitting element 16*a*. The projection lenses having the shapes according to Embodiments 1 to 4 can be adopted as the projection lens 100. Light emitted from the light emitting element 16*a* of the light source module 16 enters the projection lens 100 and exits from the projection lens 100 as substantially parallel light.

The projection lenses 100 according to the embodiments can be understood as below:

A: A projection lens for a lamp unit configured to be mounted in a vehicle, wherein a front surface of the projection lens is a convex surface and takes, when looking at the lamp unit from the front, a substantially round shape which is centered at an optical axis of the lamp unit in a predetermined position which lies closer to a front end portion and a substantially non-round shape at a rear end portion, the front surface changing gradually its shape from the substantially round shape to the substantially non-round shape in a region between the predetermined position and the rear end portion as it extends from the predetermined position towards the rear end portion.

B: A projection lens for a lamp unit configured to be mounted in a vehicle, wherein a front surface of the projection lens is a convex surface and an outline of the front surface which bounds a cross section which is parallel to a plane which contains a full circumference of a rear end portion thereof takes a substantially round shape in a predetermined position which lies close to a front end portion and a substantially non-round shape at the rear end portion, the outline changing gradually its shape from the substantially round shape to the substantially non-round shape as it changes its position from the predetermined position towards the rear end portion.

What is claimed is:

1. A lamp unit configured to be mounted in a vehicle, comprising:

a light source;

a light source mounting portion on which the light source is mounted; and a projection lens having a front surface with a convex shape and configured to project light from the light source to the front of the lamp unit, wherein when looking at the lamp unit from the front, the front surface of the projection lens takes a substantially round shape which is centered at an optical axis of the lamp unit in a position which lies closer to a front end portion and a substantially non-round shape at a rear end portion, the front surface changing gradually its shape from the substantially round shape to the substantially non-round shape in a region between the position and the rear end portion as it extends from the position towards the rear end portion.

2. A lamp unit configured to be mounted in a vehicle, comprising:

a light source;

a light source mounting portion on which the light source is mounted; and a projection lens having a front surface with a convex shape and configured to project light from the light source to the front of the lamp unit, wherein an outline of the front surface of the projection lens which bounds a cross section which is parallel to a plane which contains a full circumference of a rear end portion takes a substantially round shape in a position which lies close to a front end portion and a substantially non-round shape at the rear end portion, the outline changing gradually its shape from the substantially round shape to the substantially non-round shape as it changes its position from the position towards the rear end portion.

3. The lamp unit according to claim 1, wherein in a rear surface of the projection lens, a first region which contains a point of intersection which intersects an optical axis of the lamp unit takes a substantially rotationally symmetric shape which is centered at the point of intersection, and a second region outside of the first region takes a shape defined by a free curved surface, wherein light that passes through a rear focal point of the projection lens to enter the first region of the rear surface exits from a region defined from the front end portion to the position of the front surface, and wherein light that passes through the rear focal point of the projection lens to enter the second region exits from a region defined between the position to the rear end portion of the front surface.

4. The lamp unit according to claim 2, wherein in a rear surface of the projection lens, a first region which contains a point of intersection which intersects an optical axis of the lamp unit takes a substantially rotationally symmetric shape which is centered at the point of intersection, and a second region outside of the first region takes a shape defined by a free curved surface, wherein light that passes through a rear focal point of the projection lens to enter the first region of the rear surface exits from a region defined from the front end portion to the position of the front surface, and wherein light that passes through the rear focal point of the projection lens to enter the second region exits from a region defined between the position to the rear end portion of the front surface.

5. The lamp unit according to claim 1, wherein the substantially non-round shape is a polygonal shape, and wherein the front surface of the projection lens has ridges in the region defined from the rear end portion to the position and has no ridge in a region defined from the position to the front end portion.

6. The lamp unit according to claim 2, wherein the substantially non-round shape is a polygonal shape, and wherein the front surface of the projection lens has ridges in the region defined from the rear end portion to the position and has no ridge in a region defined from the position to the front end portion.

* * * * *